United States Patent [19]

Gerber

[11] 4,332,887

[45] Jun. 1, 1982

[54] METHOD FOR PREPARING PHOTOSENSITIVE SILVER HALIDE EMULSIONS

[75] Inventor: Arthur M. Gerber, Belmont, Mass.

[73] Assignee: Polaroid Corporation, Cambridge, Mass.

[21] Appl. No.: 194,561

[22] Filed: Oct. 6, 1980

[51] Int. Cl.[3] ..... G03C 1/02; G03C 1/28

[52] U.S. Cl. ..... 430/567; 430/569; 430/603

[58] Field of Search ..... 430/567, 569, 603

[56] References Cited

U.S. PATENT DOCUMENTS

| | | | |
|---|---|---|---|
| 2,222,264 | 11/1940 | Nietz et al. | 430/603 |
| 3,260,605 | 7/1966 | Sutherns | 430/569 |
| 3,672,901 | 6/1972 | Ohkubo et al. | 430/569 |
| 4,046,576 | 9/1977 | Terwilliger et al. | 430/569 |
| 4,150,994 | 4/1979 | Maternaghan | 430/569 |
| 4,177,071 | 12/1979 | De Brabandere et al. | 430/966 |

FOREIGN PATENT DOCUMENTS

| | | | |
|---|---|---|---|
| 724001 | 2/1955 | United Kingdom | 430/569 |
| 1025651 | 4/1966 | United Kingdom | 430/569 |

OTHER PUBLICATIONS

Photographic Emulsion Chemistry, G. F. Duffin, The Focal Press, London, 1966, p. 59.

Making and Coating Photographic Emulsions, The Focal Press, N.Y., 1964, p. 96.

*Primary Examiner*—Mary F. Downey

*Attorney, Agent, or Firm*—Philip G. Kiely

[57] ABSTRACT

Narrow grain size distribution silver halide emulsions are prepared by:

1. Forming photosensitive silver halide grains in the presence of a water-soluble thiocyanate compound with a halide/silver molar ratio ranging from not more than about 5% molar excess of halide to not more than about a 25% molar excess of silver; and 2. Growing said grains in the presence of said water-soluble thiocyanate compound for a time sufficient to grow said grains to a predetermined grain size distribution.

9 Claims, 70 Drawing Figures

METHOD FOR PREPARING PHOTOSENSITIVE SILVER HALIDE EMULSIONS

BACKGROUND OF THE INVENTION

Grain size distribution has been treated extensively in the art because of its effect on photographic speed as well as grain surface area which relates to the absorption of sensitizing dye on the grain and the attendant effects of these factors in the various photographic products. In addition, it is well known that granularity is significantly affected by grain size. While many photographic products can satisfactorily employ silver halide emulsions possessing relatively wide grain size distributions, that is, appreciable numbers of grains of varying sizes, many applications find narrow grain size distribution silver halide emulsions preferable.

In the formation of photosensitive silver halide emulsions, the ripening or growing step during which time the silver halide grains grow is considered important. During the ripening stage the presence of an adequate concentration of a silver halide solvent, for example, excess halide, generally bromide, is employed which renders the silver halide much more soluble that it is in pure water because of the formation of complex ions. This facilitates the growth of the silver halide grains. While excess bromide and ammonia are the most common ripening agents, the literature also mentions the use of water-soluble thiocyanate compounds in place of bromide as well as a variety of amines. See, for example, *Photographic Emulsion Chemistry,* G. F. Duffin, The Focal Press London, 1966, page 59.

Zelikman and Levi, *Making and Coating Photographic Emulsions,* The Ford Press, N.Y. 1964, page 96, have stated that as time increases in first ripening or growth step of a neutral silver halide emulsion prepared with a large excess of bromide ion, the width of the grain size distribution curve increases as well as the average grain size. Thus, the distribution becomes progressively wider and is shifted into the coarse-grained region as ripening proceeds.

To avoid a widening of grain size distribution by Ostwald ripening, it is known in the art to employ a pAg feedback control system that prevents a significant excess of halide from being present during silver halide grain formation.

The art has also disclosed the employment of a water-soluble thiocyanate compound as being present during the formation of the grains, that is, during the actual precipitation of the photosensitive silver halide. For example, U.S. Pat. No. 3,320,069 discloses a water-soluble thiocyanate compound which is present as a silver halide grain ripener either during actual precipitation of the light sensitive silver halide or added immediately after precipitation. The precipitation of the siler halide grains in the aforementioned patent is carried out, however, with an excess of halide.

U.S. Pat. No. 4,046,576 is directed to a method for the continuous formation of photosensitive silver halide emulsions wherein a silver salt is reacted with a halide salt in the presence of gelatin to form a photosensitive silver halide emulsion and said formation takes place in the presence of a sulfur-containing silver halide grain ripening agent, such as a water-soluble thiocyanate compound, and the thus-formed silver halide emulsion is continuously withdrawn from the reaction chamber while silver halide grain formation is occurring. During precipitation the halide concentration in the reaction medium is maintained at less than 0.010 molar. The patent states that it is known in the art to prepare silver halide grains in the presence of an excess of silver ions. The patent relates to such a precipitation with the additional steps of continually adding the sulfur-containing ripening agent and continually withdrawing silver halide grains as they are formed.

U.S. Pat. No. 4,150,994 is directed to a method of forming silver iodobromide or iodochloride emulsions which are of the twinned type which comprises the following steps:

(a) forming a monosized silver iodide dispersion;

(b) mixing in the silver iodide dispersion aqueous solutions of silver nitrate and alkali or ammonium bromides or chlorides in order to form twinned crystals;

(c) performing Ostwald ripening in the presence of a silver solvent, such as ammonium thiocyanate, to increase the size of the twinned crystals and dissolve any untwinned crystals;

(d) causing the twinned crystals to increase in size by adding further aqueous silver salt solution and alkali metal or ammonium halide; and (e) optionally removing the water-soluble salts formed and chemically sensitizing the emulsion.

A novel method has now been found for forming photosensitive silver halide emulsions with a narrow grain size distribution.

SUMMARY OF THE INVENTION

The present invention is directed to a novel method for forming a photosensitive silver halide emulsion having a relatively narrow grain size distribution which comprises the steps of precipitating photosensitive siver halide grains in the presence of a water-soluble thiocyanate compound wherein said precipitation takes place in a halide/silver molar ratio of not more than about 5% molar excess of halide to not more than about 25% molar excess of silver, and, subsequent to the grain formation, growing the thus-formed grains in the presence of said water-soluble thiocyanate for a time sufficient to obtain the desired grain size distribution. Preferably, the precipitation takes place with a halide to silver molar ratio of less than 1, i.e., a slight excess of silver.

BRIEF DESCRIPTION OF THE DRAWINGS

FIGS. 1–2*b* depict the grain-growing characteristics of the emulsion of Example 1;

FIGS. 3–4*a* depict the grain-growing characteristics of the emulsion of Example 2;

FIGS. 5–6*f* depict the grain-growing characteristics of the emulsion of Example 3;

FIGS. 7–8*f* depict the grain-growing characteristics of the emulsion of Example 4;

FIGS. 9–10*g* depict the grain growing characteristics of the emulsion of Example 5; and FIGS. 11–12*e* depict the grain-growing characteristics of the emulsion of Example 6.

DETAILED DESCRIPTION OF THE INVENTION

Figure 1:
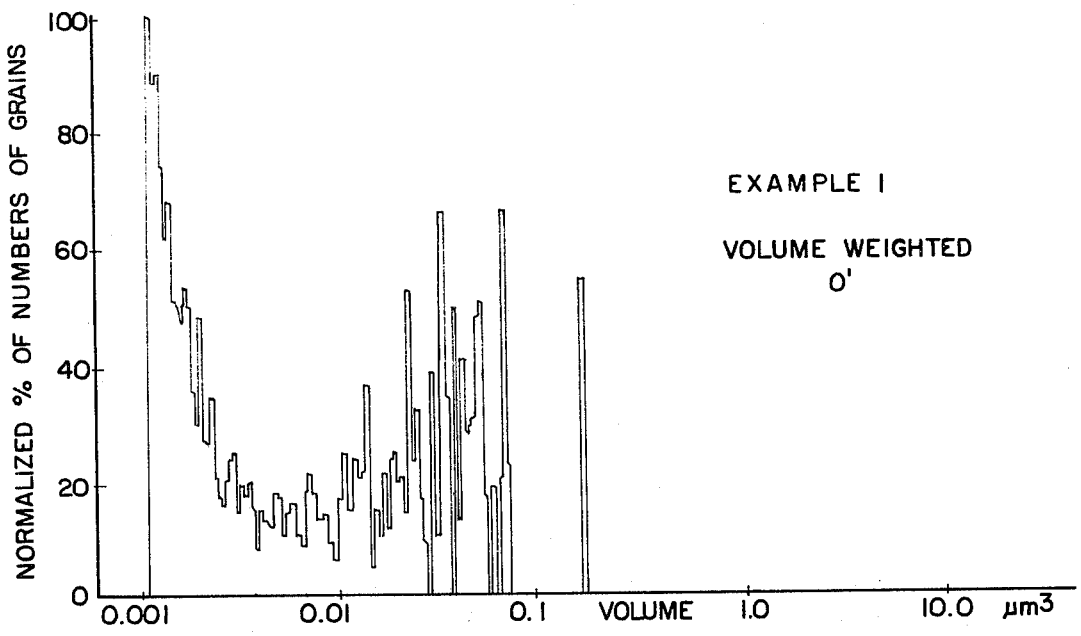
FIGS. 1–12*g* represent grain size distribution curves measured at various times during the growing of emulsions within the scope of the present invention as well as prior art emulsions as controls for comparison. Grain size distributions were determined using an electrolytic grain size analyzer (EGSA). This analyzer measures the size of reduction pulses from individual silver halide grains and converts these data to grain size distribution curves. Additional details may be found in "Grain Size Distribution By Electrolytic Reduction,"*Photographic Science and Engineering,* Vol. 17, No. 3, May/June 1973, p. 295. The upper curve on each sheet, which is volume weighted, is obtained by multiplying each volume by the number of grains of that volume, while the bottom curve is simply the number of grains of each volume.
Figure 2:
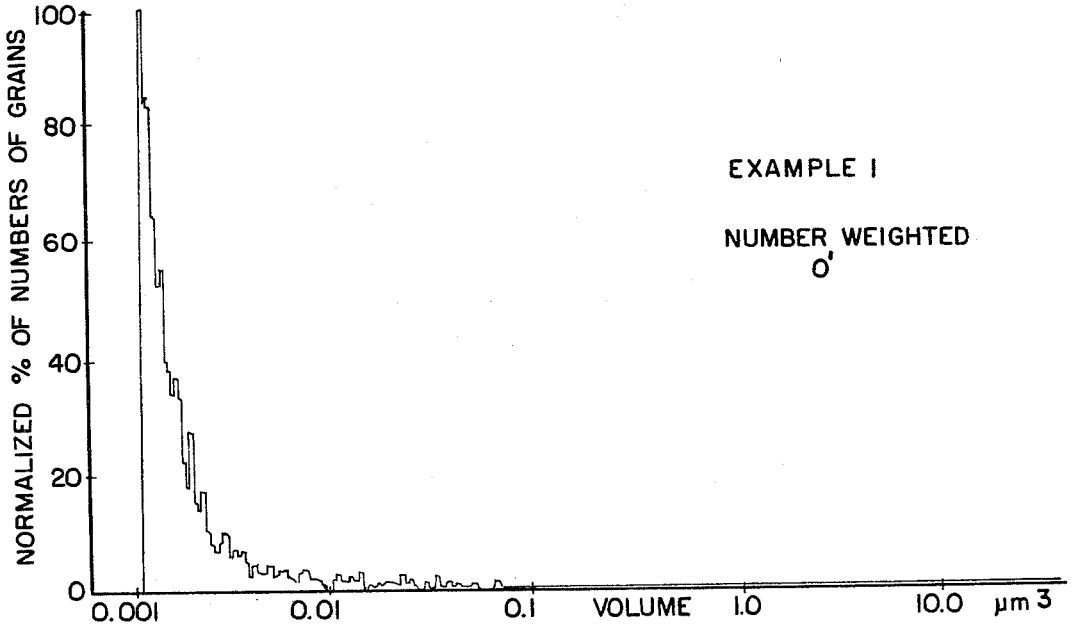

In the novel process of the present invention the formation of the silver halide grains require the following essential features:

That the precipitation occur in the presence of a water-soluble thiocyanate, e.g., potassium thiocyanate, ammonium thiocyanate or sodium thiocyanate;

That the precipitation be carried out in not more than 5% molar excess halide nor more than about a 25% molar excess silver, and preferably in an excess of silver; and That subsequent to said precipitation, and without removing the water-soluble thiocyanate, the grains are grown for a time sufficient to obtain a predetermined grain size distribution. The growing step is preferably carried out substantially in the absence of any other ripening agent. Thus, although another ripening agent other than bromide may also be present, such as ammonia, it should be understood that the thiocyanate is the primary ripening agent and the advantages of the invention are achieved by the use of the thiocyanate. Preferably, no additional thiocyanate is added other than what was present during precipitation.

The term "water-soluble thiocyanate compound" as used herein is intended to exclude thiocyanate compounds that contain cations deleterious to the photographic emulsion. Otherwise, the particular cation is not critical to the present invention. The terms "ripening" or "growth" as used herein is intended to refer to physical or Ostwald ripening and not chemical sensitization.

The water-soluble thiocyanate compound is employed at a level ranging from about 0.015–1.5 moles per mole of silver. In a preferred embodiment 0.2 moles per mole of silver of thiocyanate compound is employed. As stated above, the ripening or holding time of the thus-formed silver halide grains may vary over a relatively wide range and will be determined empirically for the particular grain size distribution desired. Generally, the longer the ripening period the narrower the grain size distribution. However, with extended growing times the larger grains do not get substantially larger. Only small changes in grain size occur after extended periods. This phenomenon is contrary to what has been found in the art, i.e., as stated above, generally, extended ripening periods provide a wider grain size distribution. Generally, the ripening period ranges from about 5 minutes to 210 minutes. The time period is not critical, in that the process is self-limiting. Thus, there is no need to abruptly stop grain growth as with conventional processes.

The silver halide grains are formed by the precipitation of the reaction product of a water-soluble silver salt, such as silver nitrate, and a water soluble halide salt, such as chloride, bromide or iodide.

The precipitation step is carried out in a halide/silver molar ratio of not more than about a 5% molar excess of halide to not more than about a 25% molar excess of silver. Preferably, an excess of silver is employed, e.g., about 1–10% molar excess of silver. In a particularly preferred embodiment, a slight excess, up to about 5% molar excess silver is employed.

If the halide is present at a molar excess of over about 5%, the halide becomes a significant ripening agent and the narrow grain size distribution is not achieved.

Amounts greater than a molar excess of 25% silver are uneconomical and undesirable. Such excess silver might combine with the bromide ion from lithium bromide employed at the end of the growth step to dissolve any silver thiocyanate, as described below. The reaction of excess silver with the bromide would form a new population of silver bromide grains which would not possess the already formed grain size distribution.

Subsequent to the grain formation and growth, other steps conventional in the emulsion preparation art may be employed such as separation of the grains by floccing or ultrafiltration, washing, and chemical and spectral sensitization.

In one embodiment of the present invention, chemical sensitization can be carried out before washing since the present invention does not employ the large excess of halide which in prior art methods can inhibit effective chemical sensitization.

It may also be desirable in the present invention to treat the grains subsequent to the growth step with a solution of a soluble bromide salt, such as lithium bromide, or other compound to dissolve silver thiocyanate crystals which may be formed in the process of the present invention. Since these silver thiocyanate crystals may be relatively large with respect to the silver halide grains, mechanical means may also be employed to separate them from the silver halide grains. It should be emphasized, however, that the lithium bromide is added at the end of the ripening period and is not intended, nor does it function, as the primary ripening agent.

By means of the present invention, uniform grain size distribution grains of silver halide are formed without the use of period art pAg control systems thus avoiding the limitations inherent in such systems, such as expense, slow rate of precipitation and the formation of grains that possess undesirable photographic properties, i.e., grains that have low photographic sensitivity due to too few crystallographic defects.

The following nonlimiting examples illustrate the novel process of the present invention.

EXAMPLE 1 (INVENTION

The following solutions were prepared:

Solution A (50° C.)
- Water: 357 cc
- Gelatin: 4.5 g

Solution B (35° C.)
- Water: 100 cc
- KBr: 20.20 g
- Ammonium thiocyanate: 4.51 g
- KI: 1.28 g Solution C (35° C.)
- Water: 100 cc
- $AgNO_3$: 31.71 g Solution D
- Lithium bromide (12.3 N): 30 cc Solutions B and C were simultaneously jetted into Solution A at 50° C. over a 5 minute period. The thus-formed emulsion was then held at 50° C. for 30 minutes after which Solution D was added over a 20 second period and the emulsion held for 20 minutes at 50° C. The grains were flocced by the addition of 10% sulfuric acid. After washing the emulsion was bulked with 14.17 g of gelatin. The mean diameter, volume-weighted, as determined by EGSA, was 0.681 μm, with a geometric standard deviation of 1.82.

EXAMPLE 2 (CONTROL)

(No thiocyanate or excess bromide)

The following solutions were prepared:
Solution A (50° C.)
Water: 397 cc
Gelatin: 4.5 g
Solution B (35° C.)
Water: 100 cc
KBr: 20.20 g
KI: 1.28 g
Solution C (35° C.)
Water: 100 cc
$AgNO_3$: 31.71 g
Solution D
Lithium bromide (12.3 N): 30 cc The emulsion was prepared by the same procedure as set forth in Example 1. The mean diameter, volume-weighted, as determined by EGSA, was 0.14 μm.

EXAMPLE 3 (INVENTION)

The following solutions were prepared:
Solution A (50° C.)
Water: 445 cc
Gelatin: 9.28 g
Solution B (35° C.)
Water: 125 cc
KBr: 39.33 g
Ammonium thiocyanate: 4.23 g
KI: 0.29 g
Solution C (35° C.)
Water: 125 cc
$AgNO_3$: 59.45 g
Solution D
Lithium bromide (12.3 N): 38 cc Solutions B and C were simultaneously jetted into Solution A at 50° C. over a 5 minute period. The thus-formed emulsion was then held at 50° C. for 60 minutes after which Solution D was added over a 10 second period and the emulsion held for 30 minutes at 50° C. The grains were flocced by the addition of 10% sulfuric acid. After washing the emulsion was bulked with 26.6 g of gelatin. The mean diameter, volume-weighted, as determined by EGSA, was 1.17 μm, with a geometric standard deviation of 1.70.

EXAMPLE 4 (CONTROL)

(Equal weight of excess bromide for thiocyanate)

The following solutions were prepared:
Solution A (50° C.)
Water: 445 cc
Gelatin: 9.28 g
Solution B (26° C.)
Water: 125 cc
KBr: 43.56 g
KI: 0.29 g
Solution C (26° C.)
Water: 100 cc
$AgNO_3$: 59.45 g
Solution D
Lithium bromide (12.3 N): 30 cc The emulsion was prepared by the same procedure as set forth in Example 3. The mean diameter, volume-weighted, as determined by EGSA, was 1.13 μm with a geometric standard deviation of 4.23.

EXAMPLE 5 (INVENTION)

The following solutions were prepared:
Solution A (50° C.)
Water: 445 cc
Gelatin: 9.28 g
Solution B (26° C.)
Water: 125 cc
KBr: 39.33 g
Ammonium Thiocyanate 4.23 g
KI: 0.29 g
Solution C (26° C.)
Water: 125 cc
$AgNO_3$: 59.45 g
Solution D (20° C.)
Lithium bromide (12.3 N): 38 cc Solutions B and C were jetted into Solution A over a period of 5 minutes. Subsequent to the precipitation step, the emulsion was held at 50° C. for 90 minutes. Solution D was then added over a 10 second period and the emulsion held for 5 minutes at 50° C. The grains were flocced by the addition of 10% sulfuric acid. After washing the emulsion was bulked with 26.6 g of gelatin. The mean diameter, volume-weighted, as determined by EGSA was 1.15 μm with a geometric standard deviation of 1.68.

EXAMPLE 6 (CONTROL)

(Equimolar excess bromide for thiocyanate)

The following solutions were prepared:
Solution A (50° C.)
Water: 445 cc
Gelatin: 9.28 g
Solution B (26° C.)
Water: 125 cc
KBr: 45.94 g
KI: 0.29 g
Solution C (26° C.)
Water: 125 cc
$AgNO_3$: 59.45 g
Solution D (20° C.)
Lithium bromide (12.3 N): 38 cc The emulsion was prepared by the procedure as set forth in Example 5. The mean diameter, volume-weighted, as determined by EGSA, was 0.564 μm, with a geometric standard deviation of 3.01.

In all of the above examples the precipitation was carried out at about a 5% molar excess of silver.

In all of the above examples derivatized gelatin is employed. The type of gelatin is not critical to the invention.

Referring now to the drawings, the grain size distributions of the emulsions prepared above are set forth. Each curve has indicated thereon the number of minutes that ripening has been carried out.

Figure 1A:
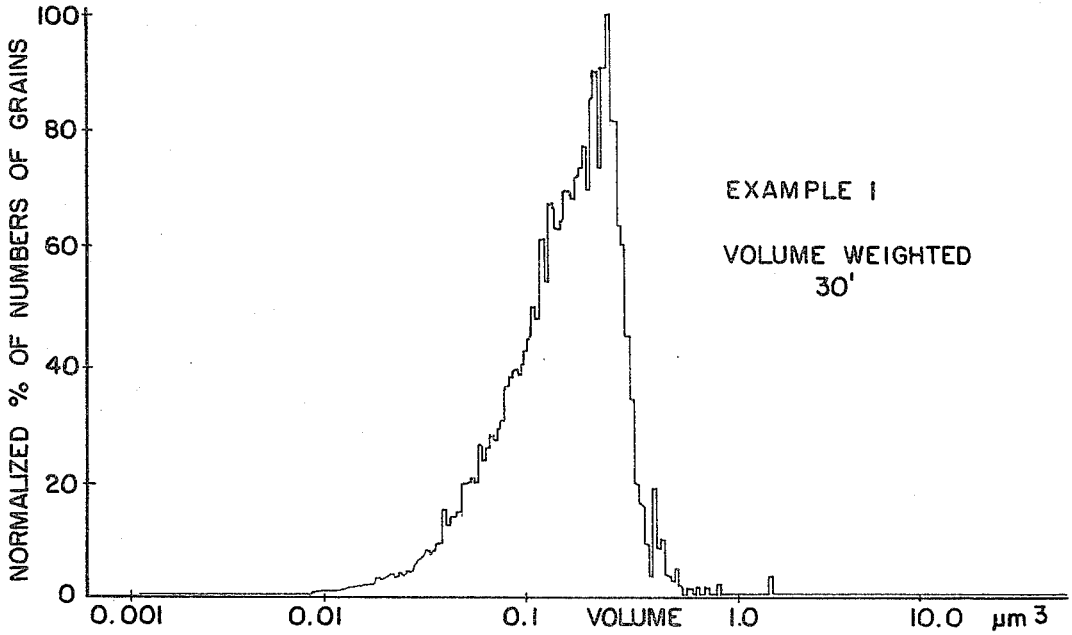
Figure 2A:
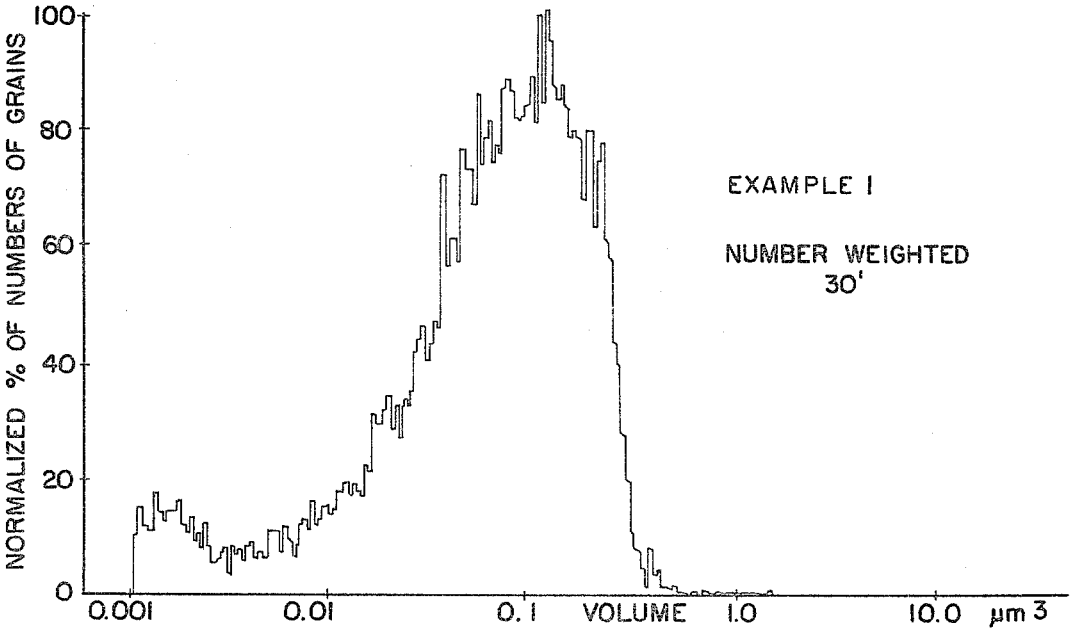
Figure 1B:
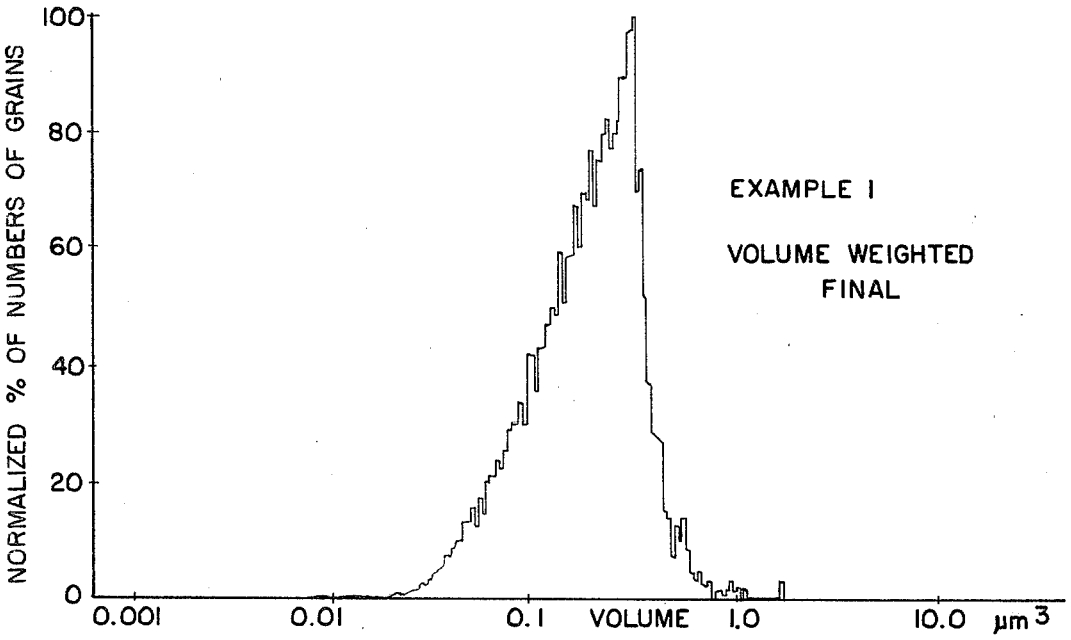
Figure 2B:
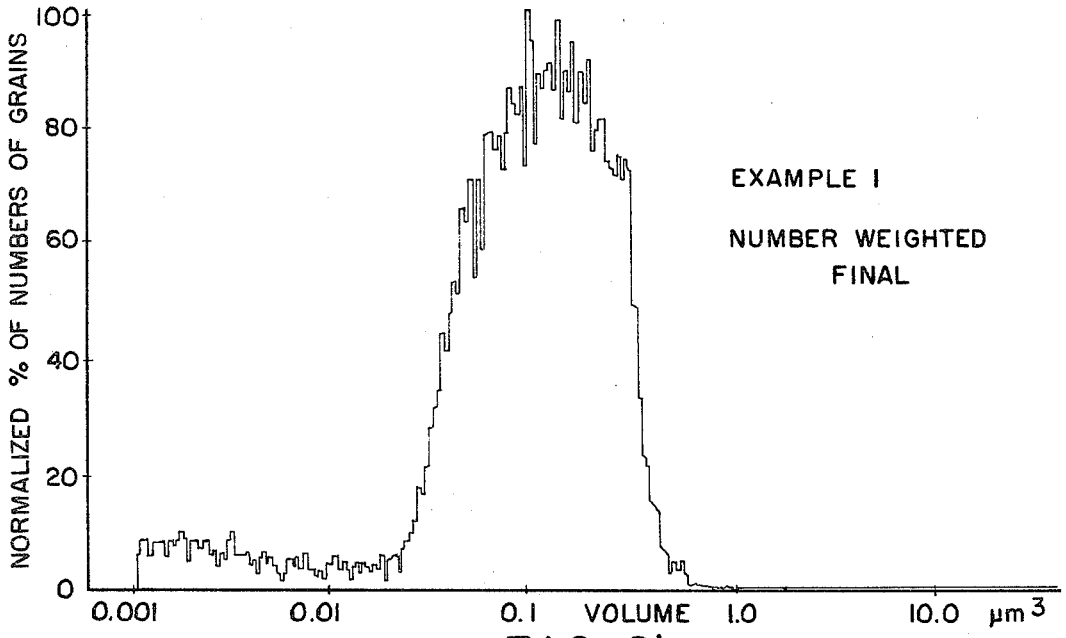

The emulsion prepared according to the procedure of Example 1 is an emulsion within the scope of the present invention and contained a 2% molar excess of silver during precipitation. Ammonium thiocyanate is present during precipitation and during the ripening period. In FIG. 1, it will be noted that there is a relatively wide grain size distribution with most of the grains being of relatively small size. Referring to FIGS. 1*a* and 2*a*, it will be noted that after a 30 minute ripening time with thiocyanate present, a large proportion of grains below 0.01 μm have been dissolved and redeposited to form larger grains of a considerably narrower grain size distribution. FIGS. 1*b* and 2*b* represent the emulsion subsequent to floccing, dissolution of silver thiocyanate by addition of lithium bromide and the addition of bulking gelatin. It will be noted that a mean grain diameter of 0.68 μm and a narrow grain size distribution is shown compared with Example 2 which showed a mean diameter of only 0.14 μm.

Figure 3:
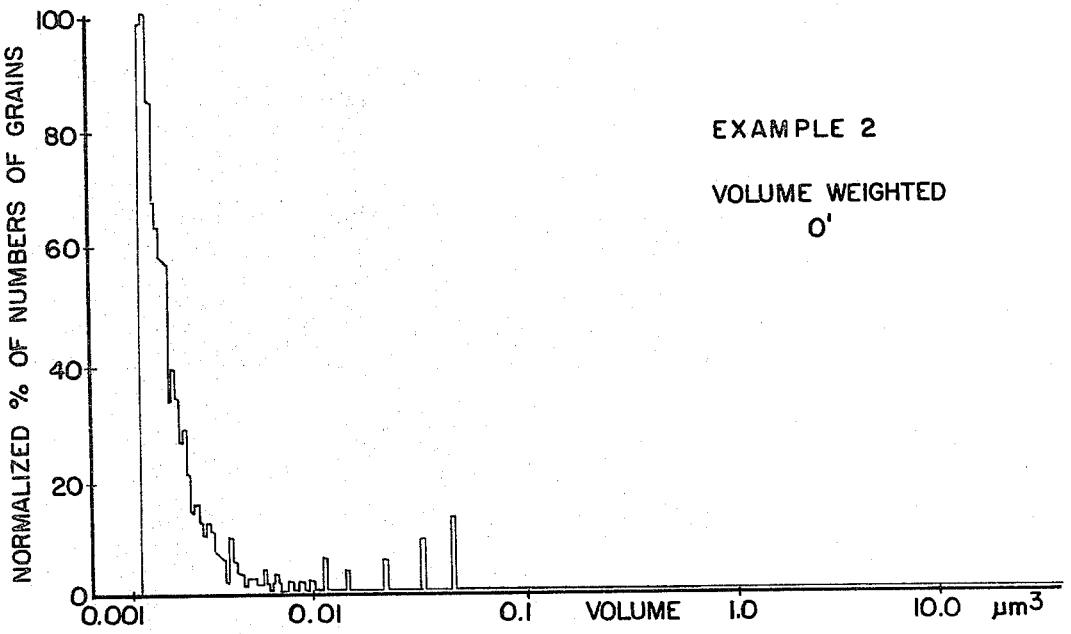
Figure 4:
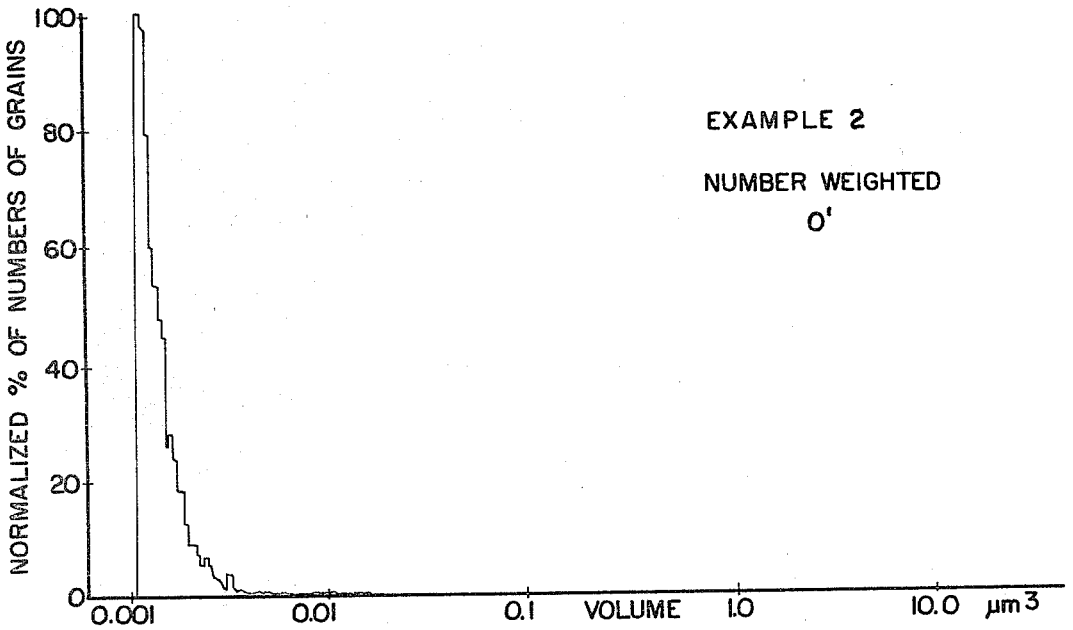
Figure 3A:
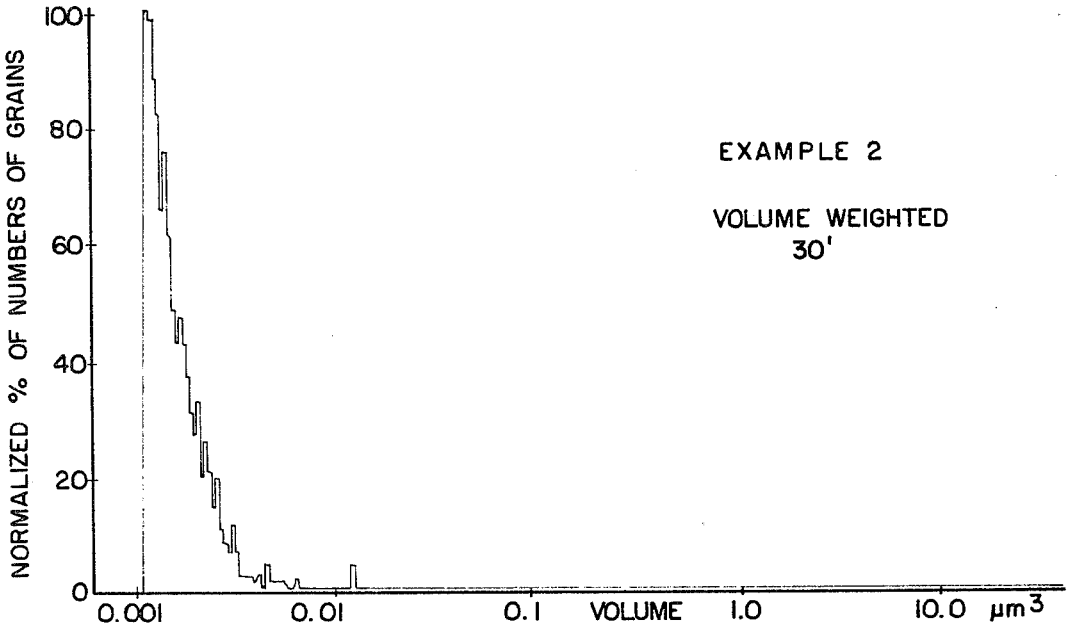
Figure 4A:
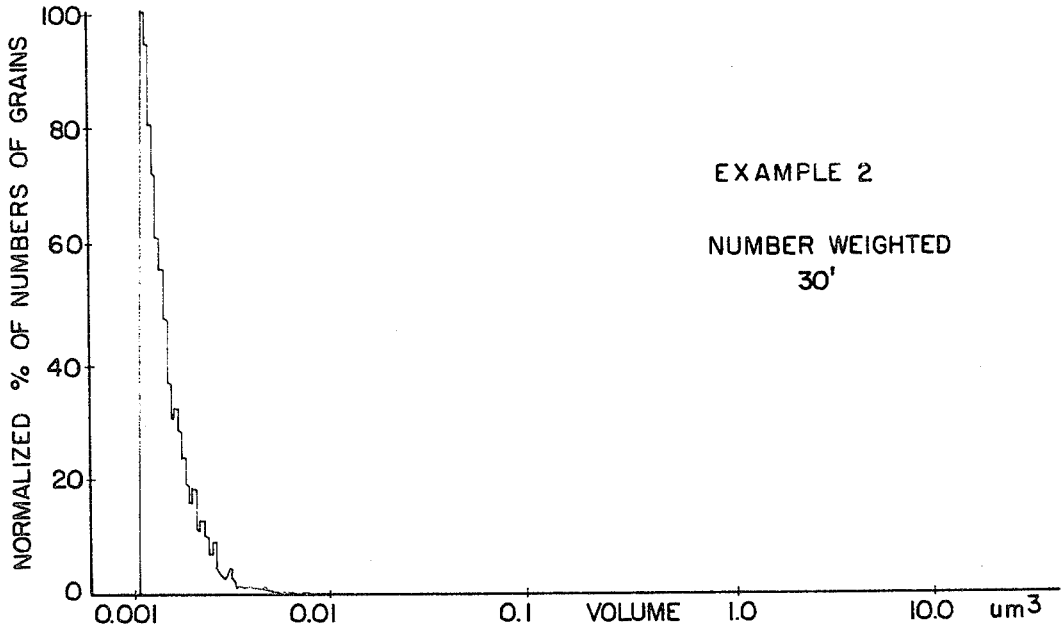

The ripening characteristics of Example 2, which is a control emulsion containing no thiocyanate but having a 2% molar excess of silver during precipitation is set forth in FIGS. 3–4*a*. It will be noted that substantially no grain growth has occurred in a thirty-minute ripening period. That is, the curve shapes are substantially the same at the end of the thirty-minute period as they were at the end of the precipitation. It will also be noted that the grains are extremely small to the point where they would be difficult to use in a conventional photographic manner.

Figure 5:
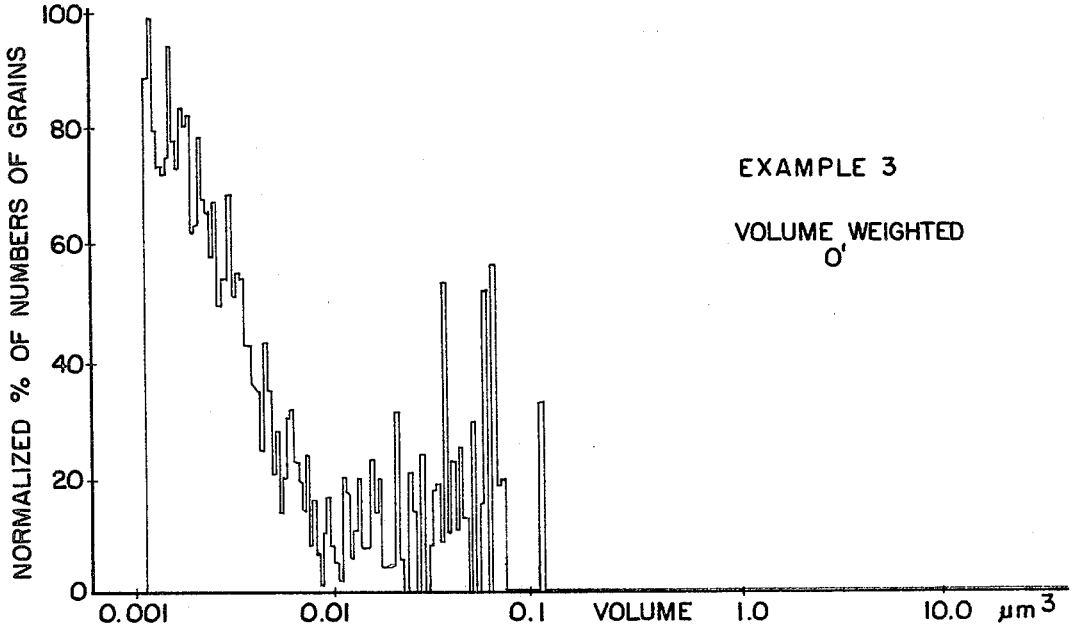
Figure 6:
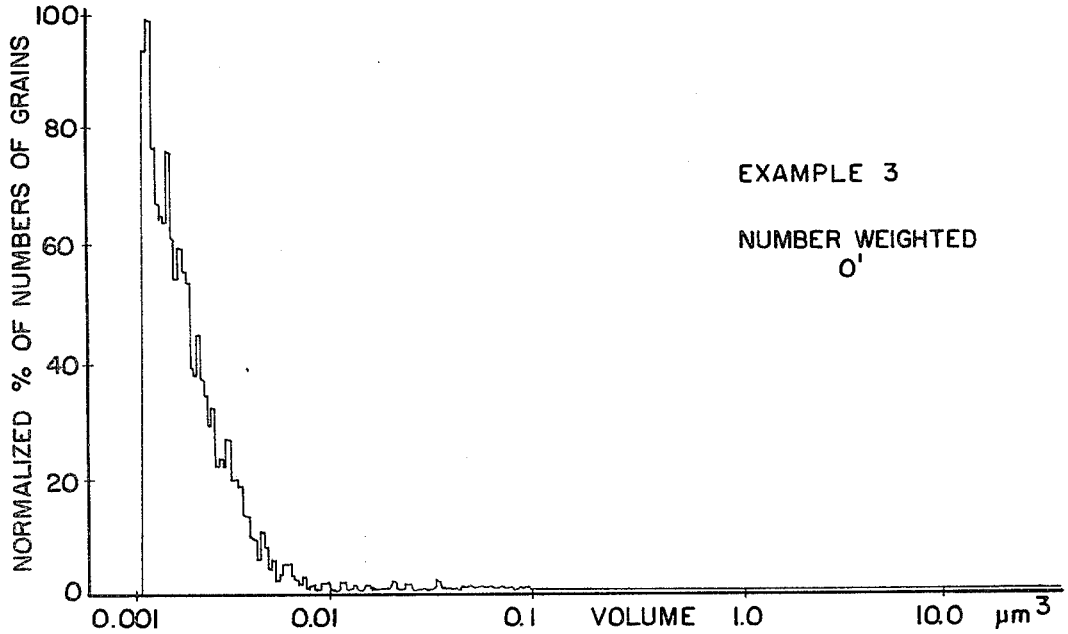
Figure 5A:
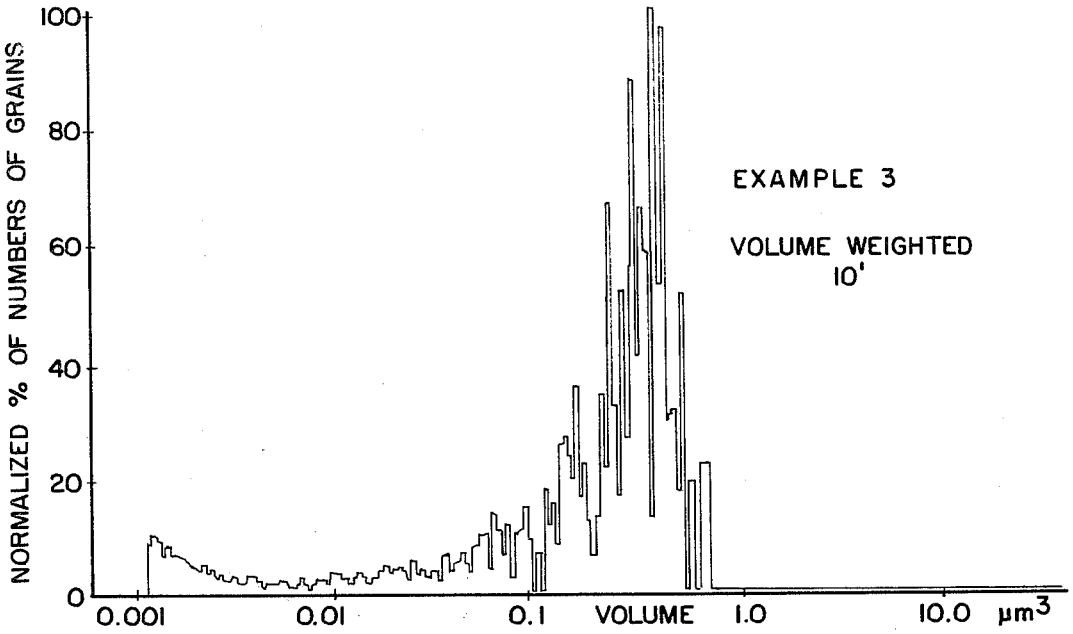
Figure 6A:
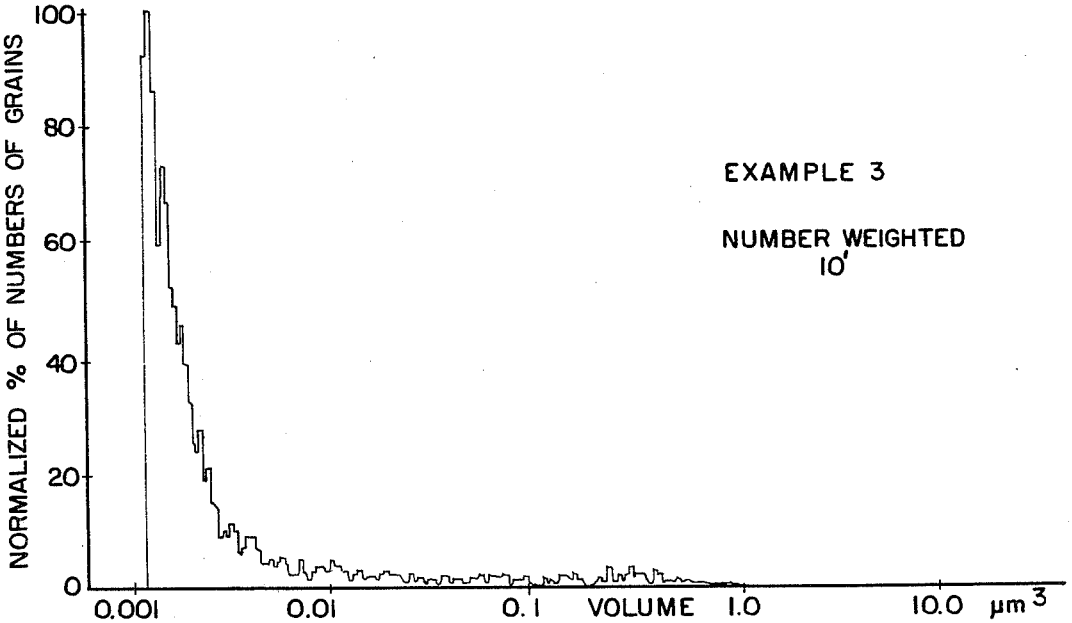
Figure 5B:
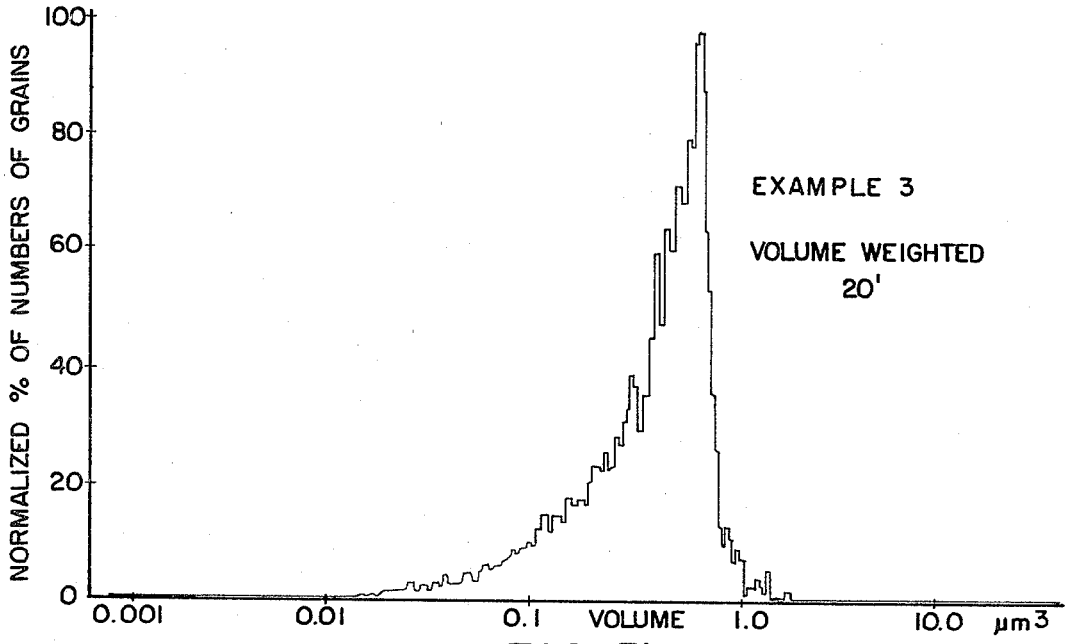
Figure 6B:
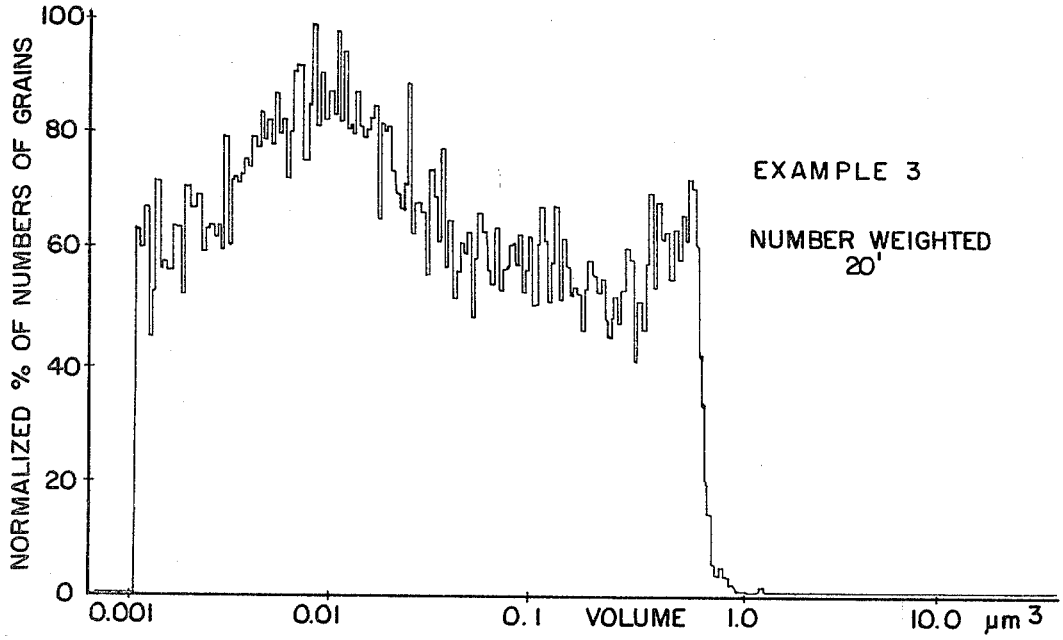
Figure 5C:
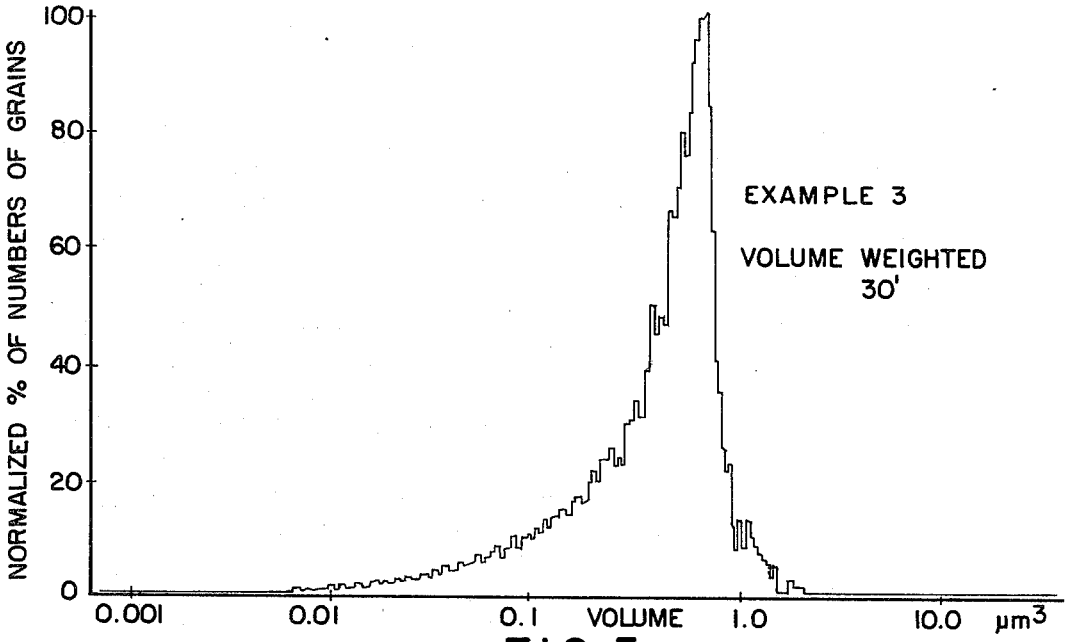
Figure 6C:
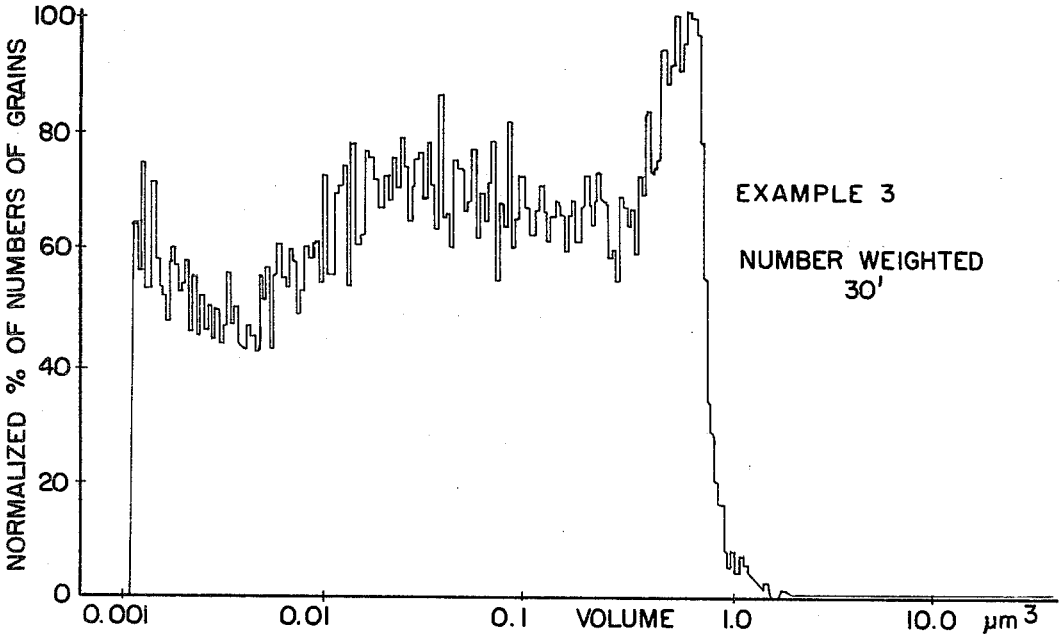
Figure 5D:
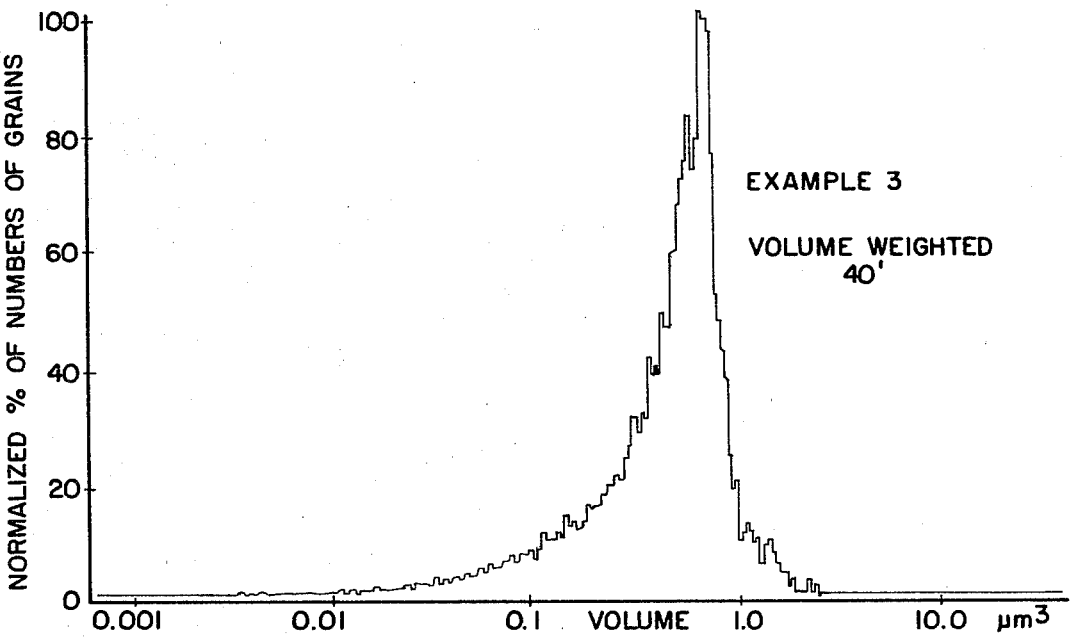
Figure 6D:
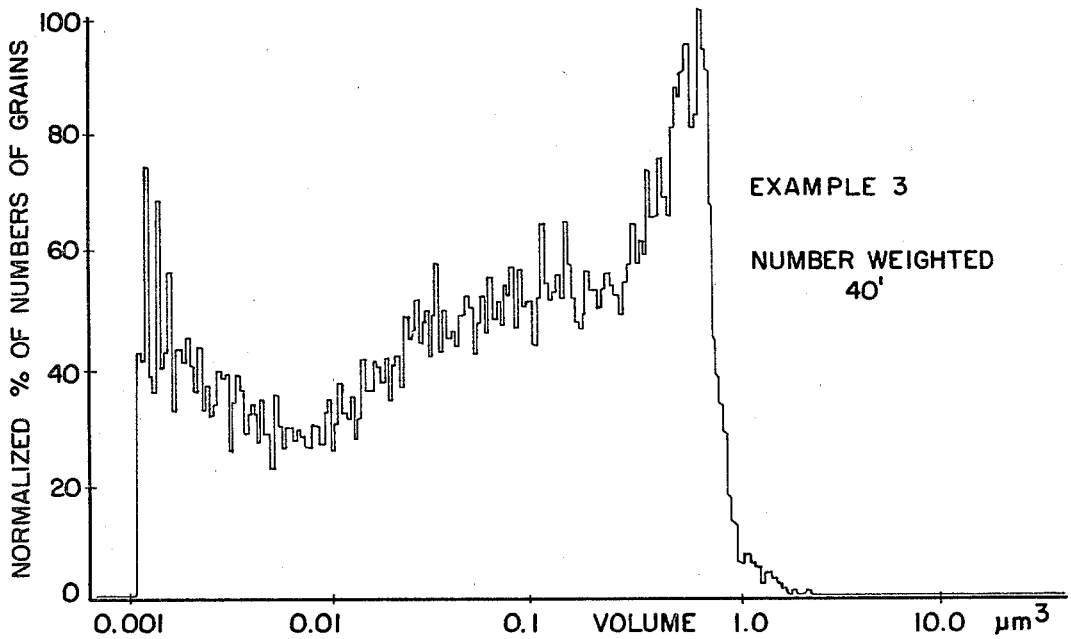
Figure 5E:
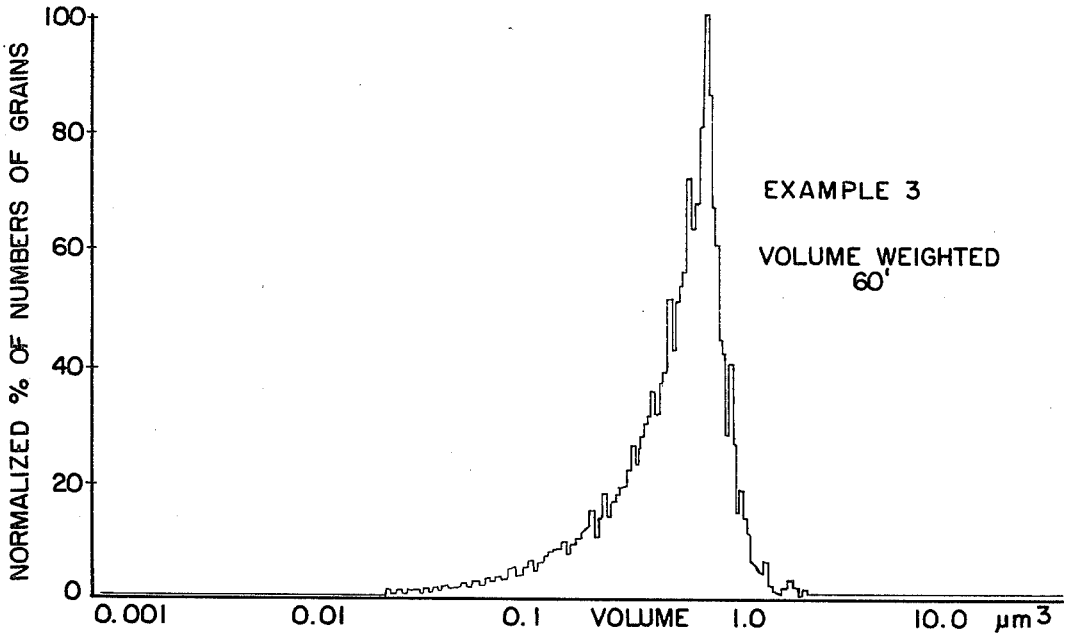
Figure 6E:
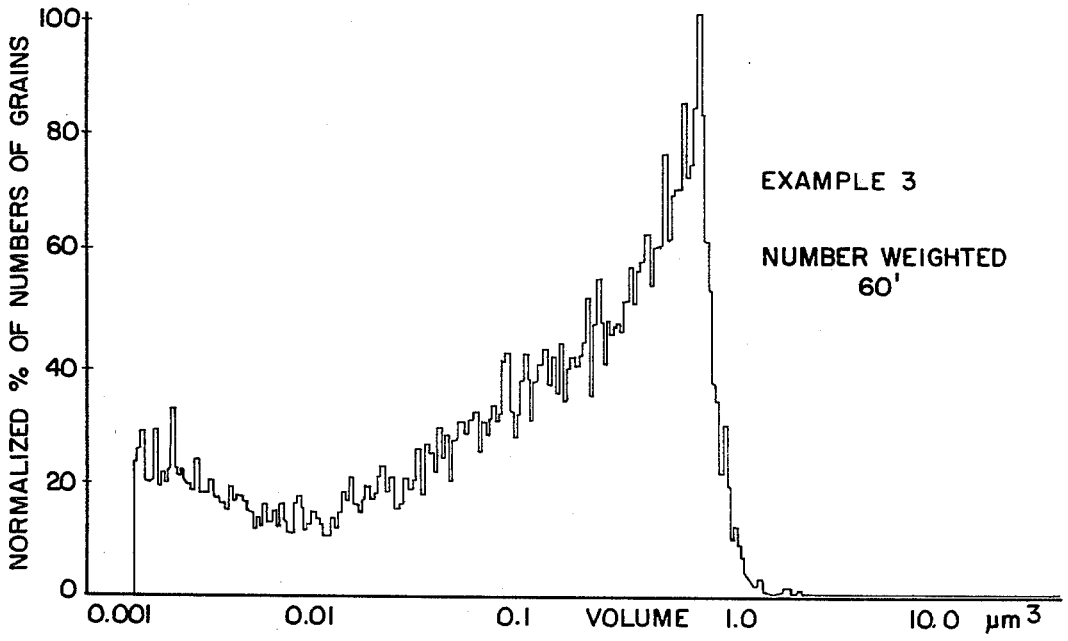
Figure 5F:
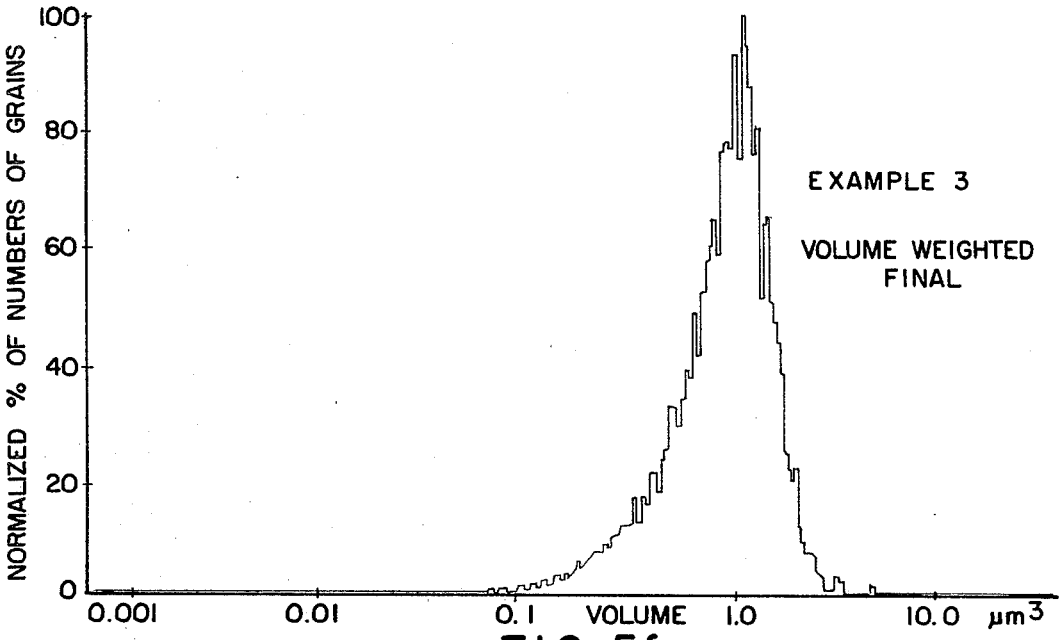
Figure 6F:
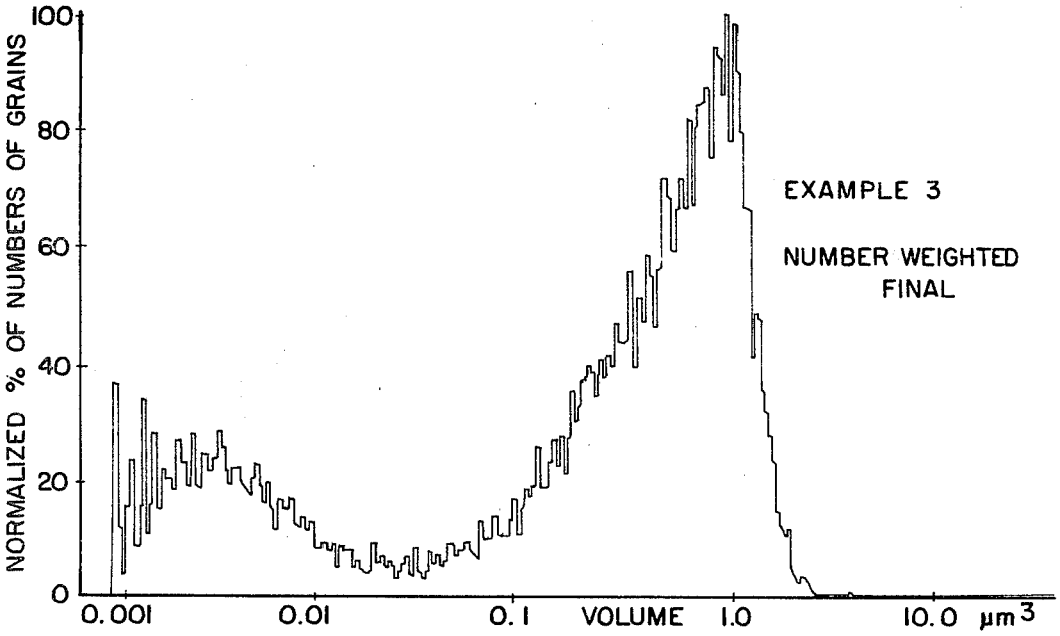

The growth characteristics of the emulsion of Example 3 are set forth in FIGS. 5–6*f*. It will be noted as with the other emulsions at the beginning of the ripening period, a relatively wide grain distribution curve is observed with the silver halide grains predominantly of a very small size. The growth of grains occurs relatively rapidly with significant formation of larger grains observed on the ten-minute and the twenty-minute curves. It will be noted that substantially all of the grain growth has occurred by about twenty minutes. However, ripening was continued and a slight narrowing of the grain size distribution curve is noted up to thirty minutes. The final emulsion shows a mean grain diameter of 1.18 μm and a geometric standard deviation of 1.70.

Figure 7:
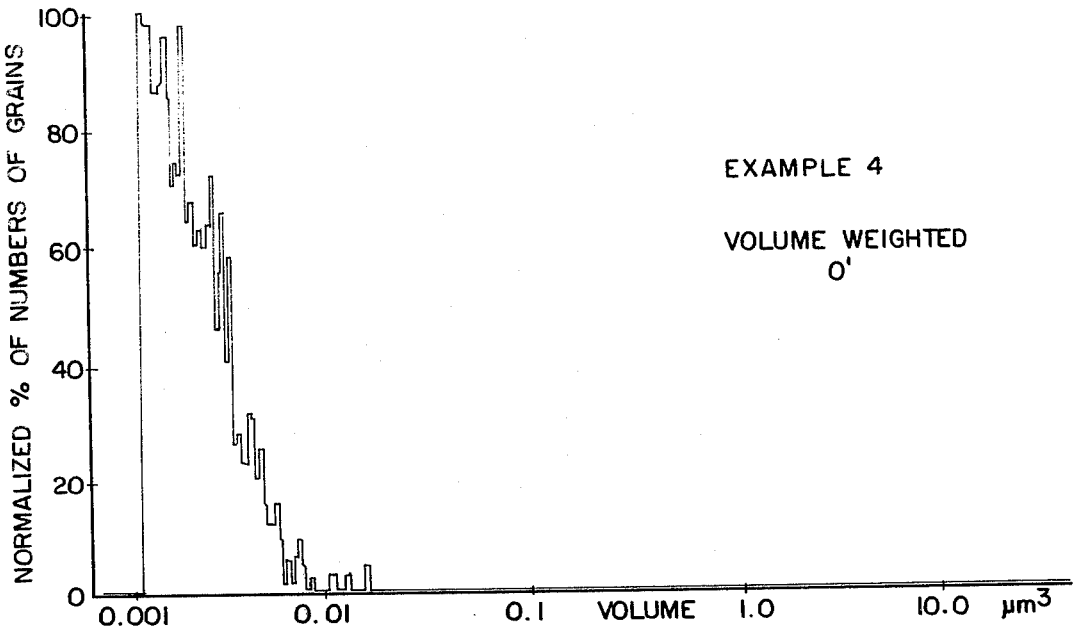
Figure 8:
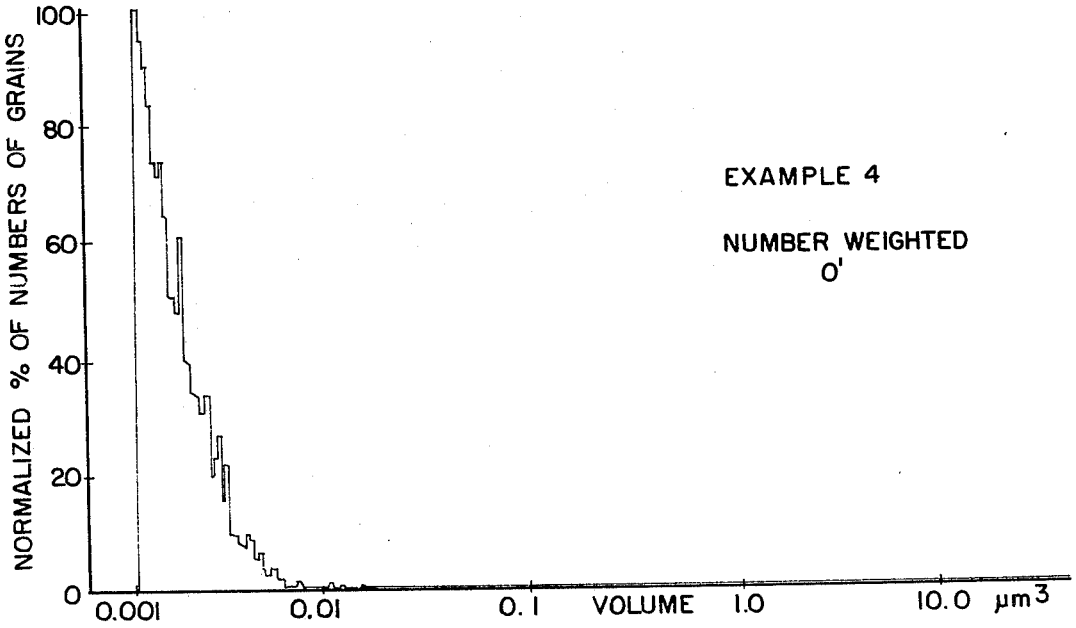
Figure 7A:
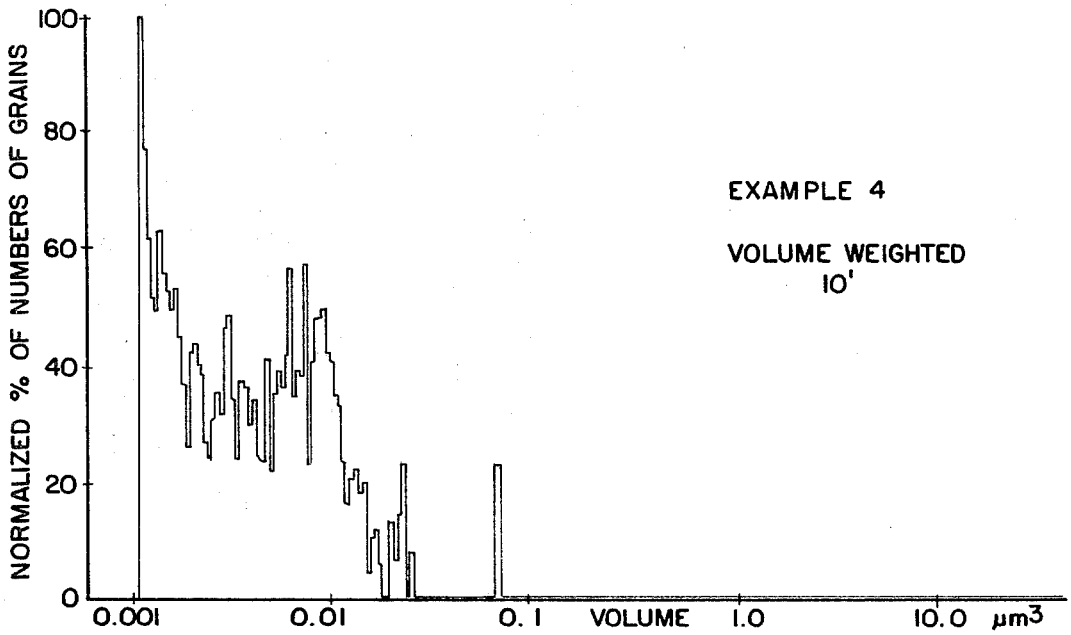
Figure 8A:
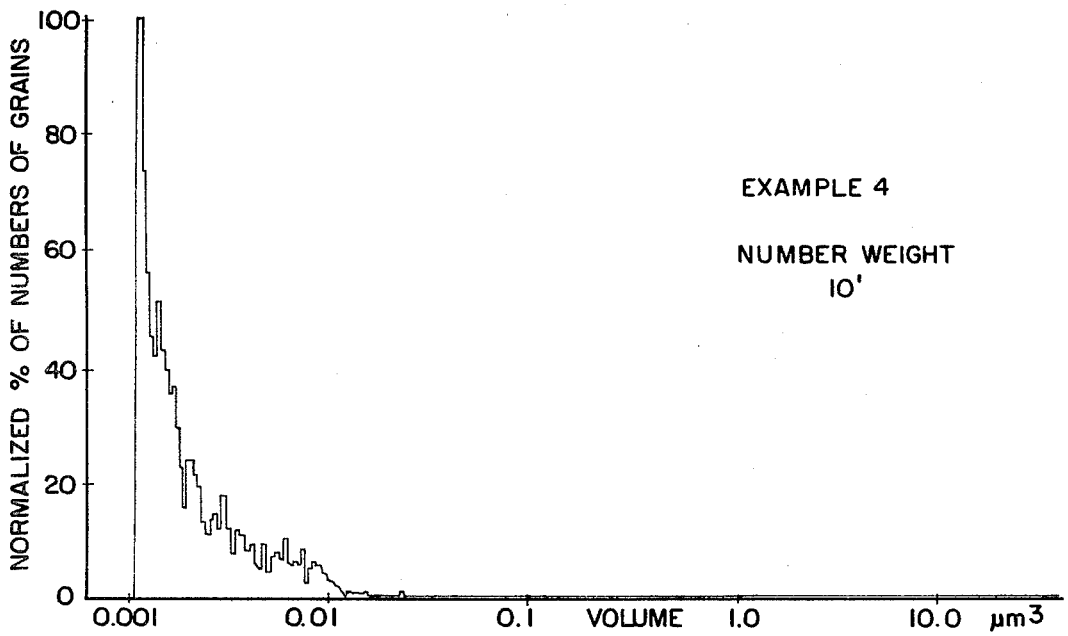
Figure 7B:
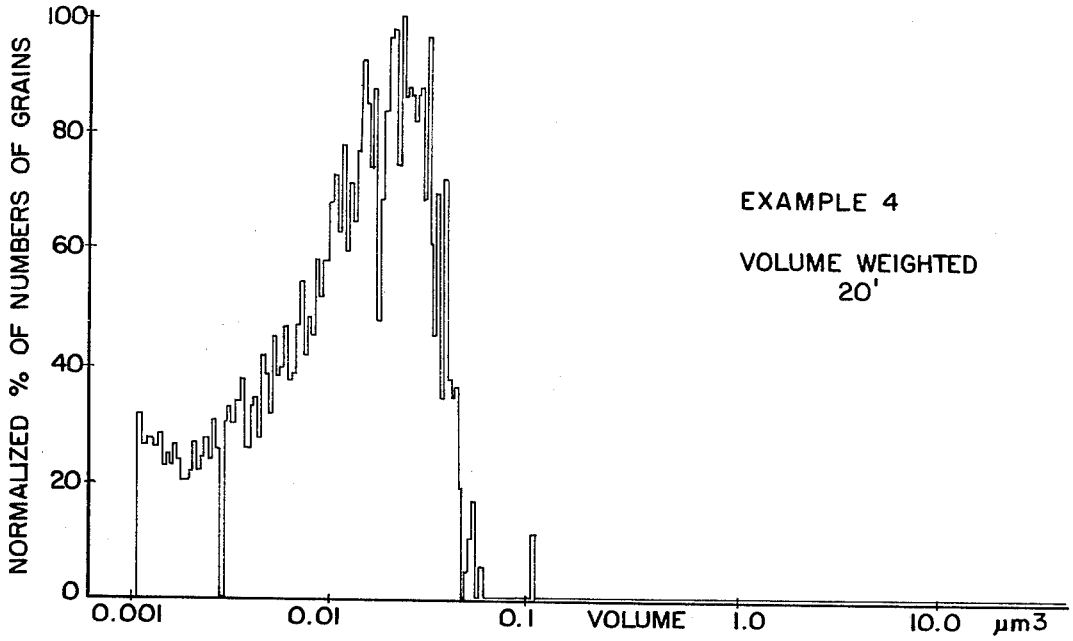
Figure 8B:
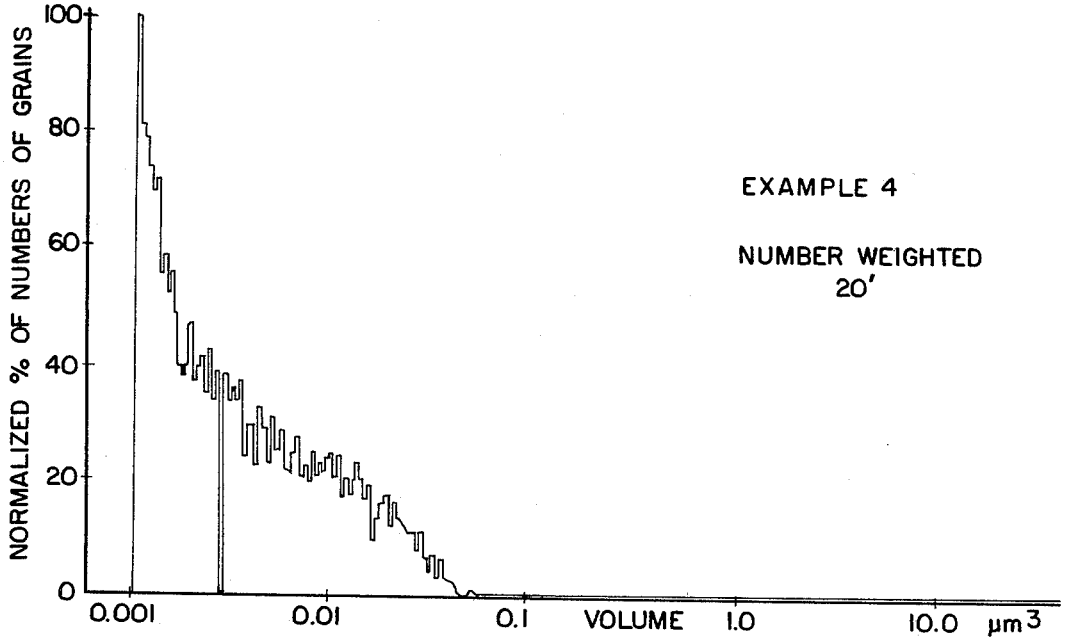
Figure 7C:
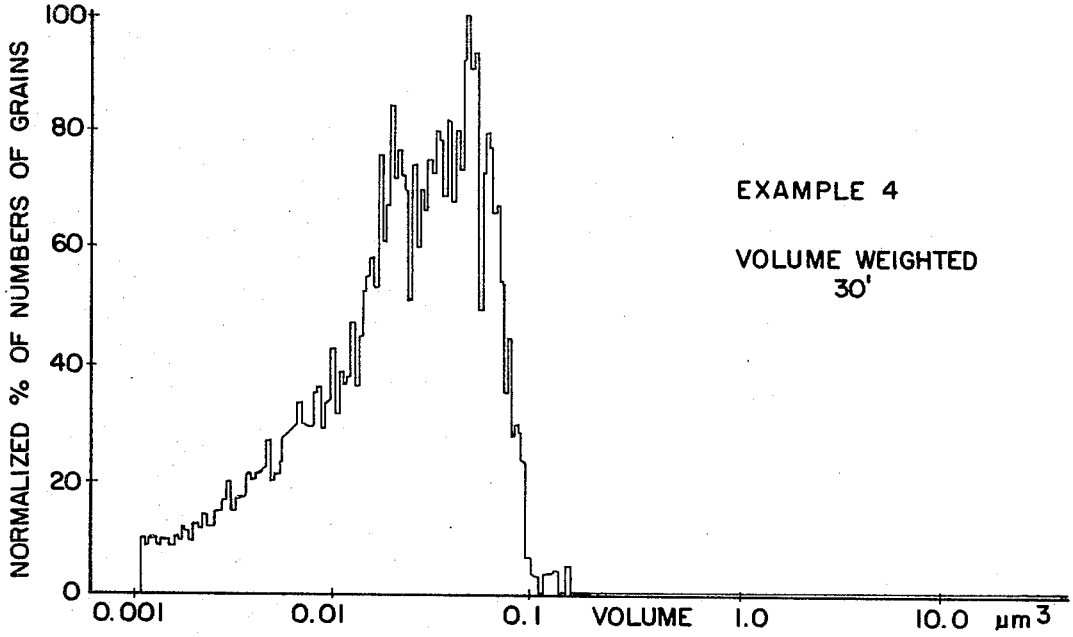
Figure 8C:
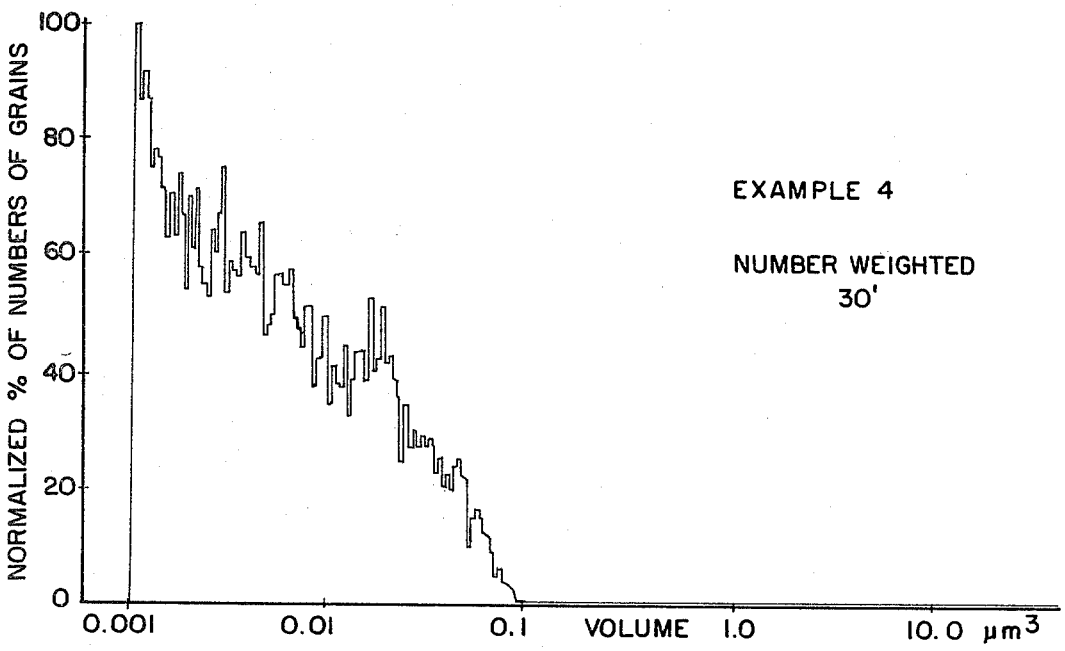
Figure 7D:
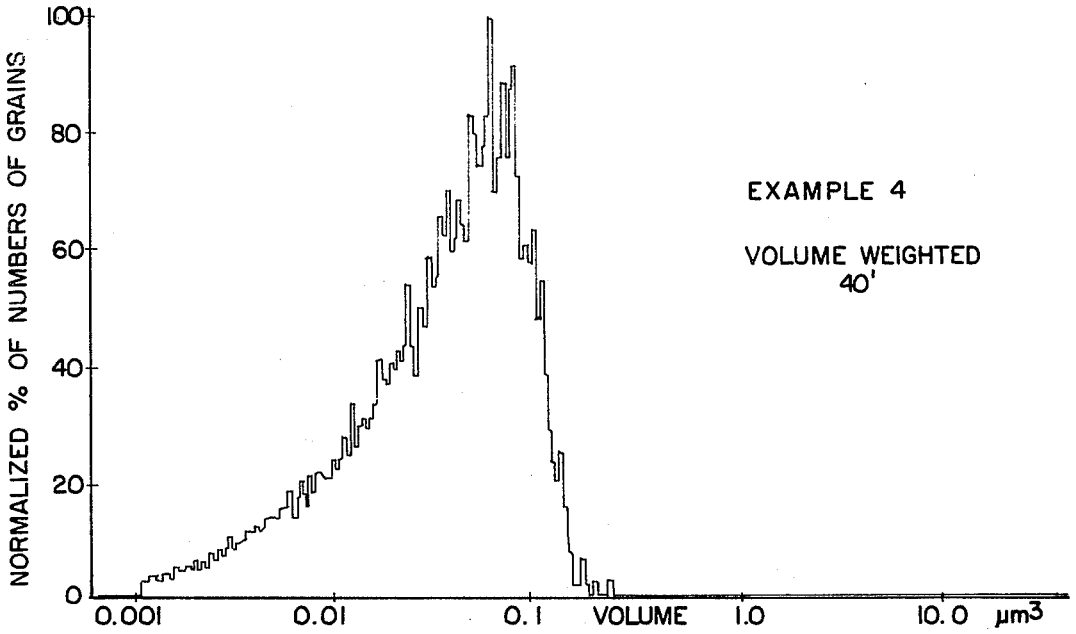
Figure 8D:
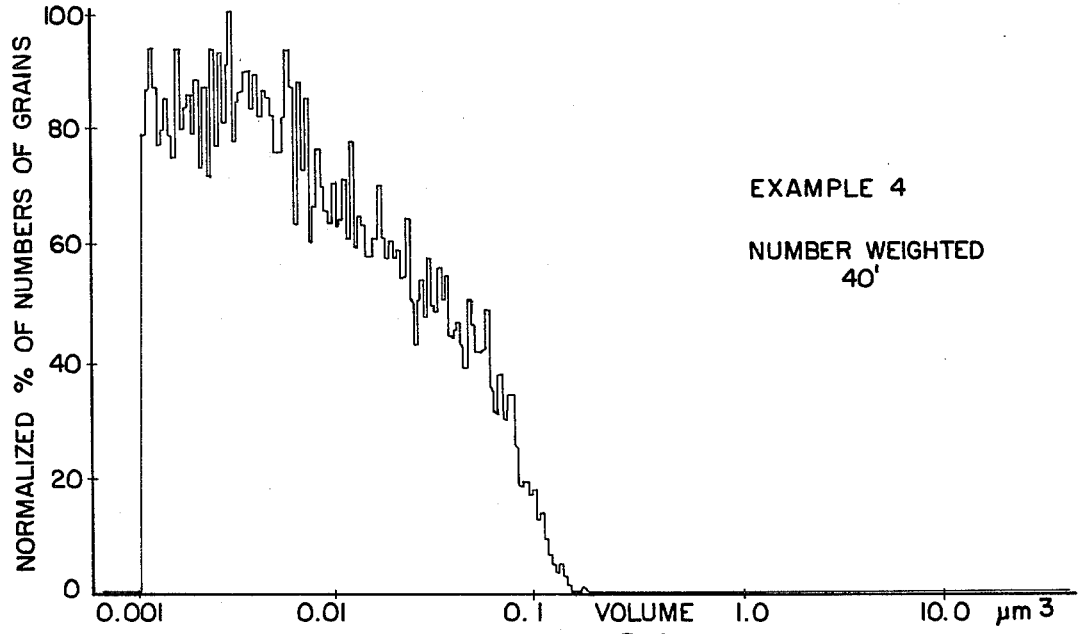
Figure 7E:
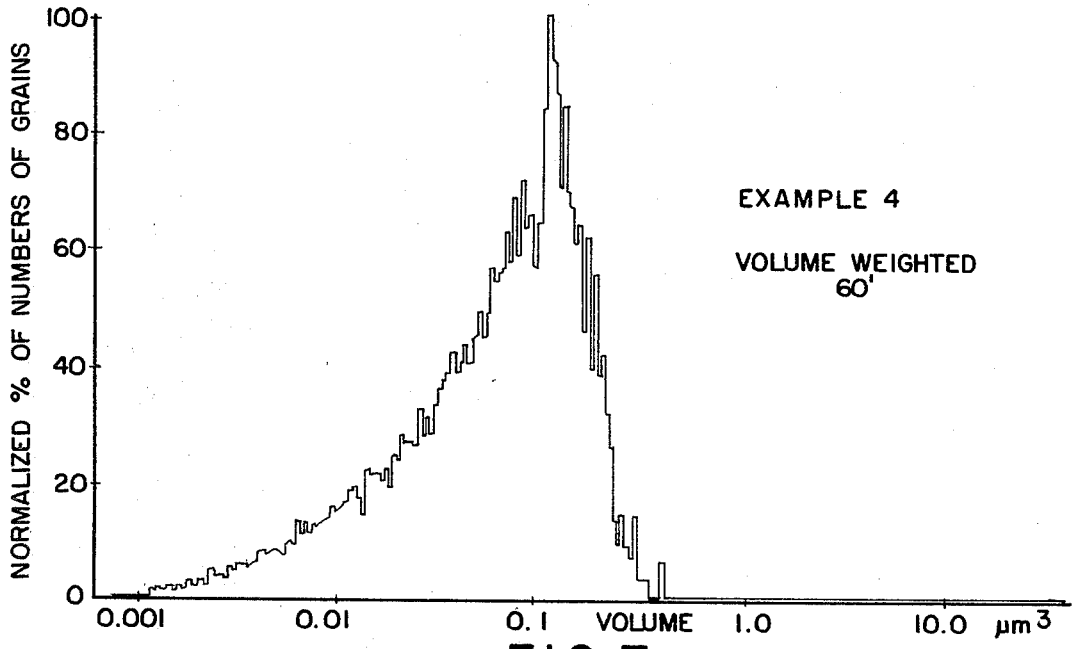
Figure 8E:
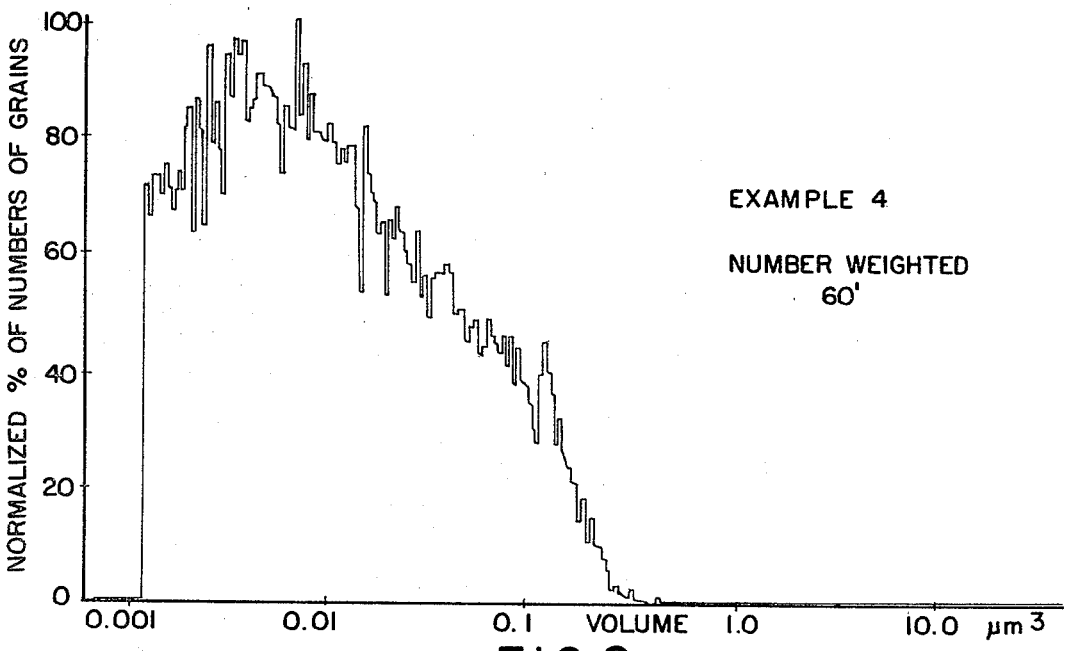
Figure 7F:
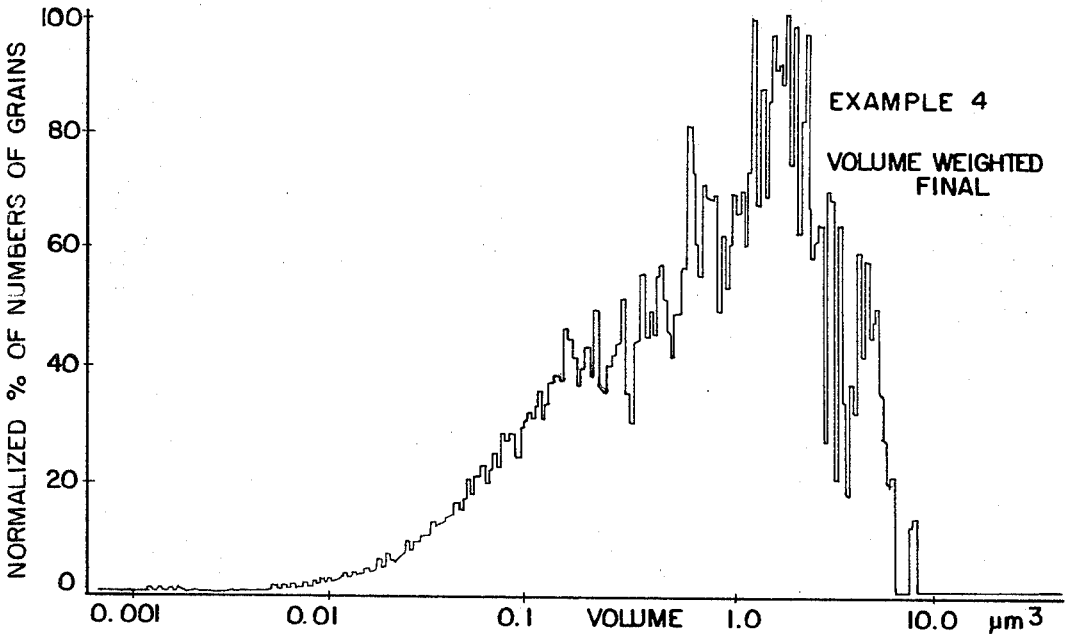
Figure 8F:
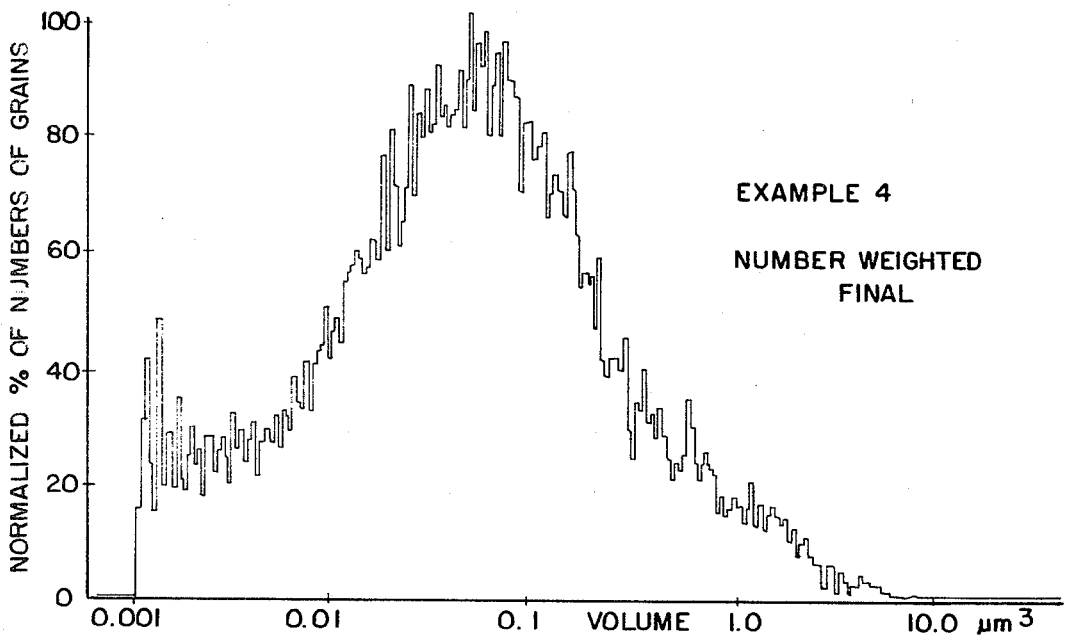

Emulsion 4 is a control and is present for comparison with Example 3. In Example 4, the ripening agent present during precipitation and ripening is a weight of excess potassium bromide equal to the weight of ammonium thiocyanate in Example 3. The ripening characteristics of the emulsion of Example 4 are set forth in FIGS. 7–8*f*. As with the other emulsions, at the beginning of the ripening period, a relatively wide grain size distribution is observed of very small grains. However, unlike the emulsions prepared by the procedure of the present invention, as the ripening proceeds and the grains grow bigger, the grain size distribution curve becomes wider. This substantiates what was stated above that has been found in the prior art; that is, upon increasing the ripening time in the presence of excess bromide, the grain size distribution curve becomes wider. The final emulsion shows a mean grain diameter of about 1.09 μm with a high geometric standard deviation of 4.23.

Figure 9:
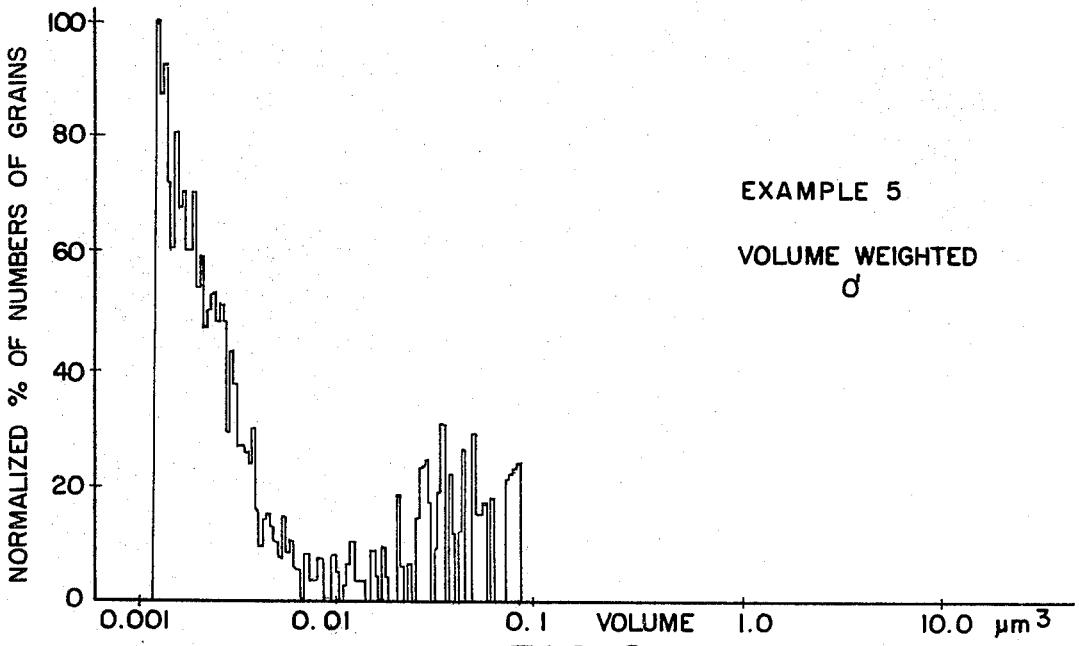
Figure 10:
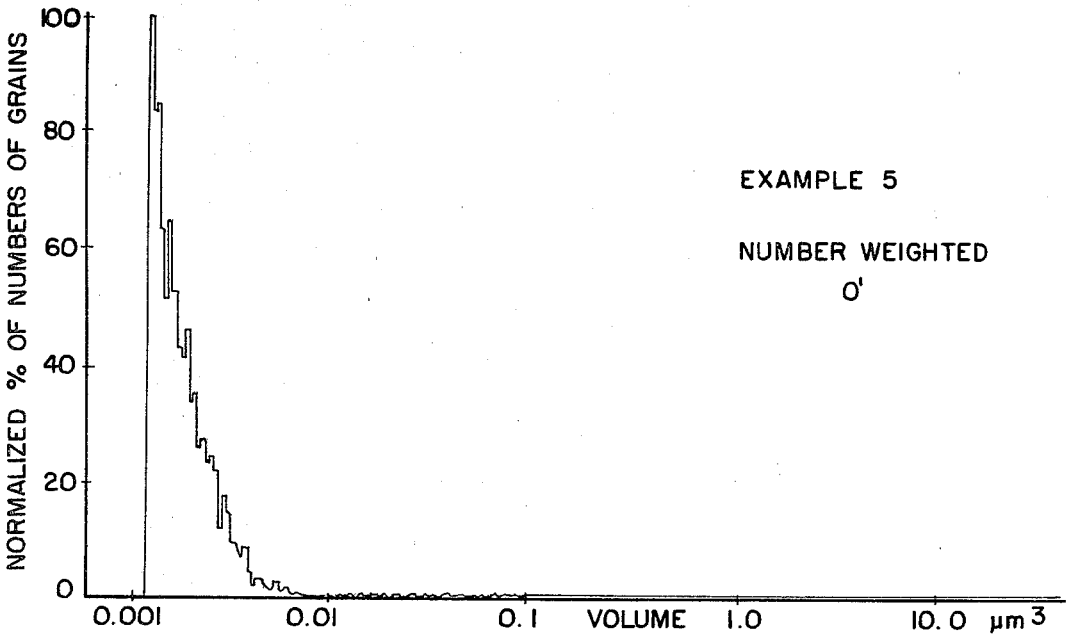
Figure 9A:
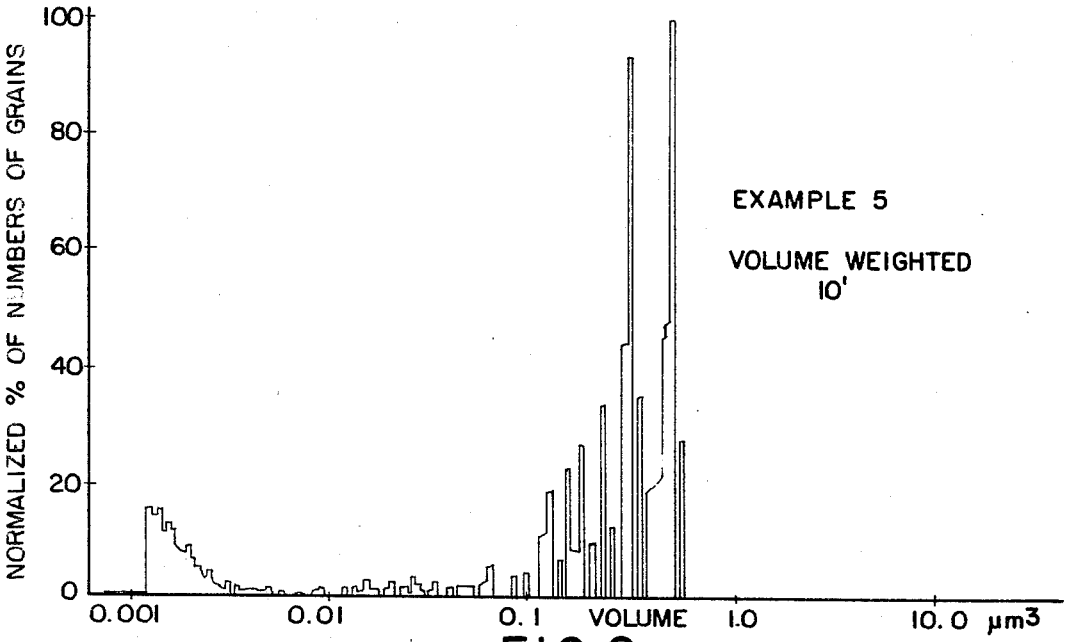
Figure 10A:
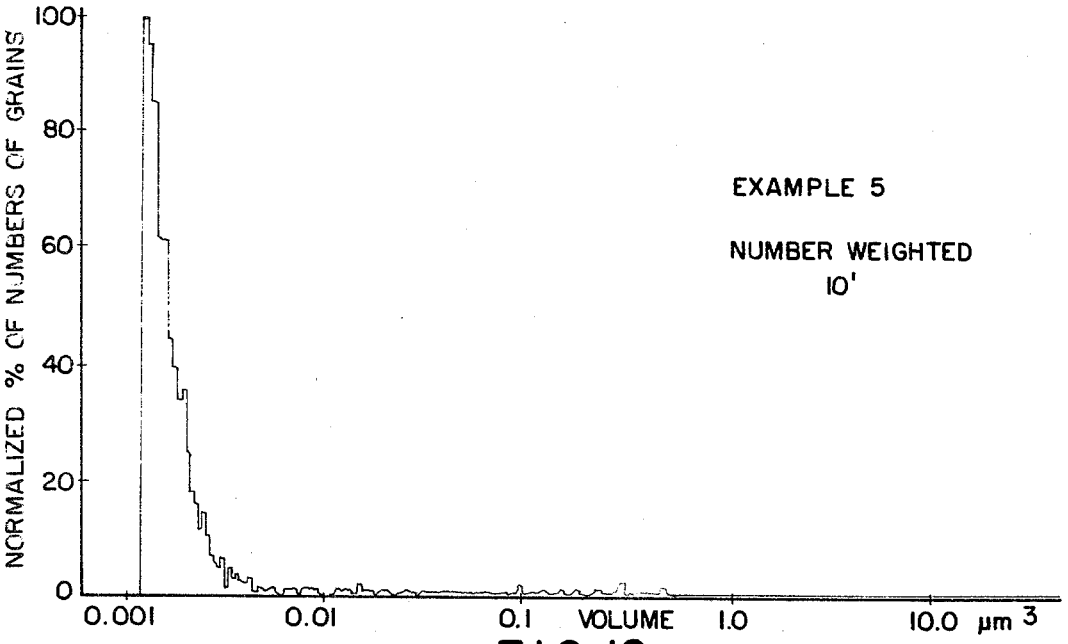
Figure 9B:
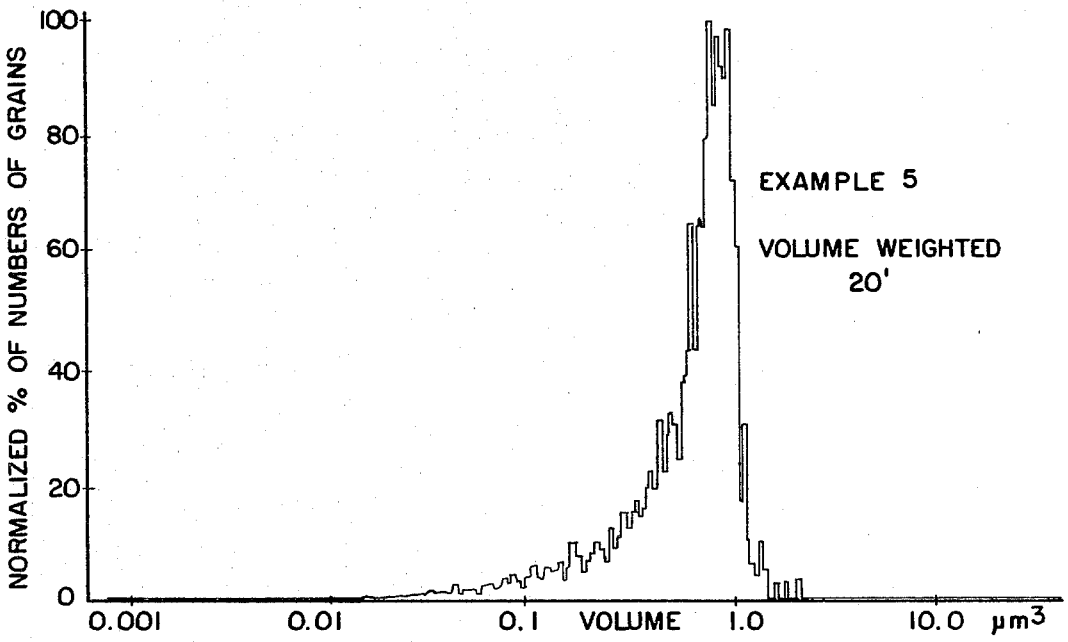
Figure 10B:
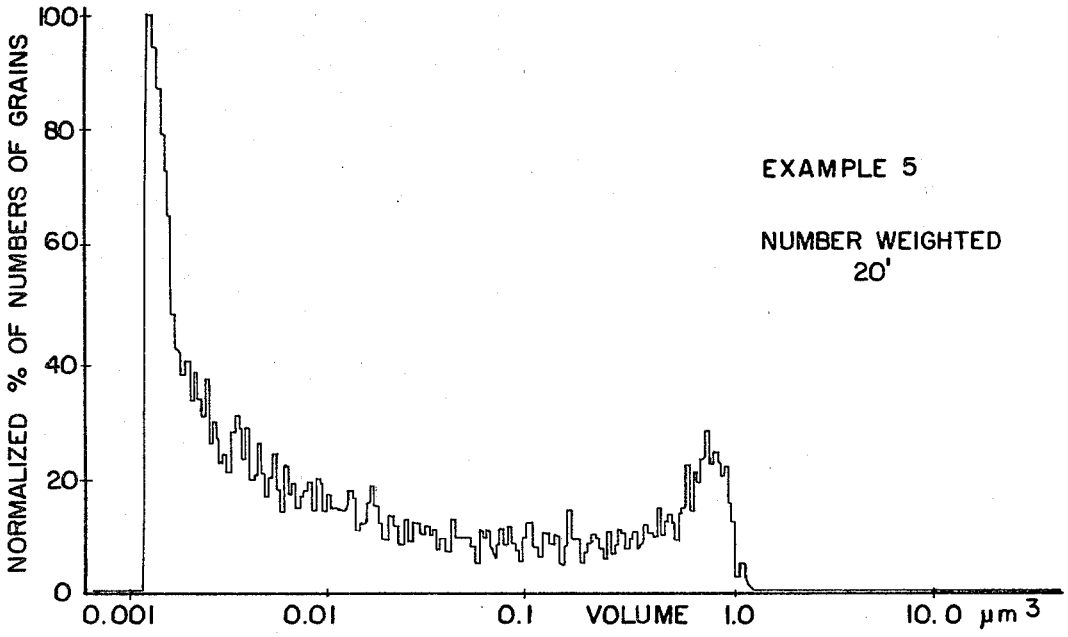
Figure 9C:
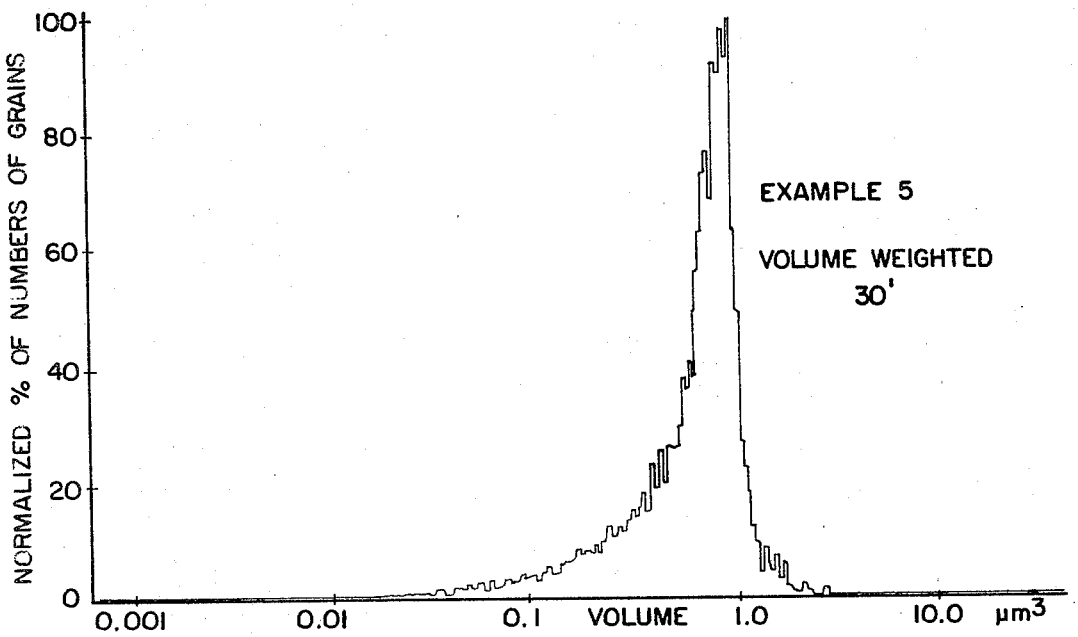
Figure 10C:
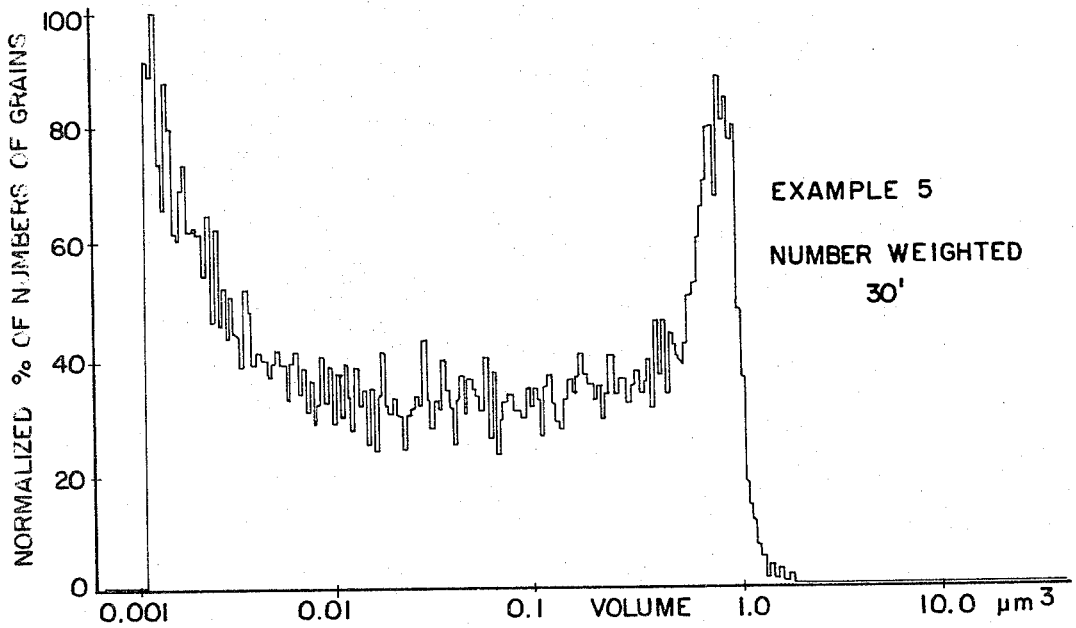
Figure 9D:
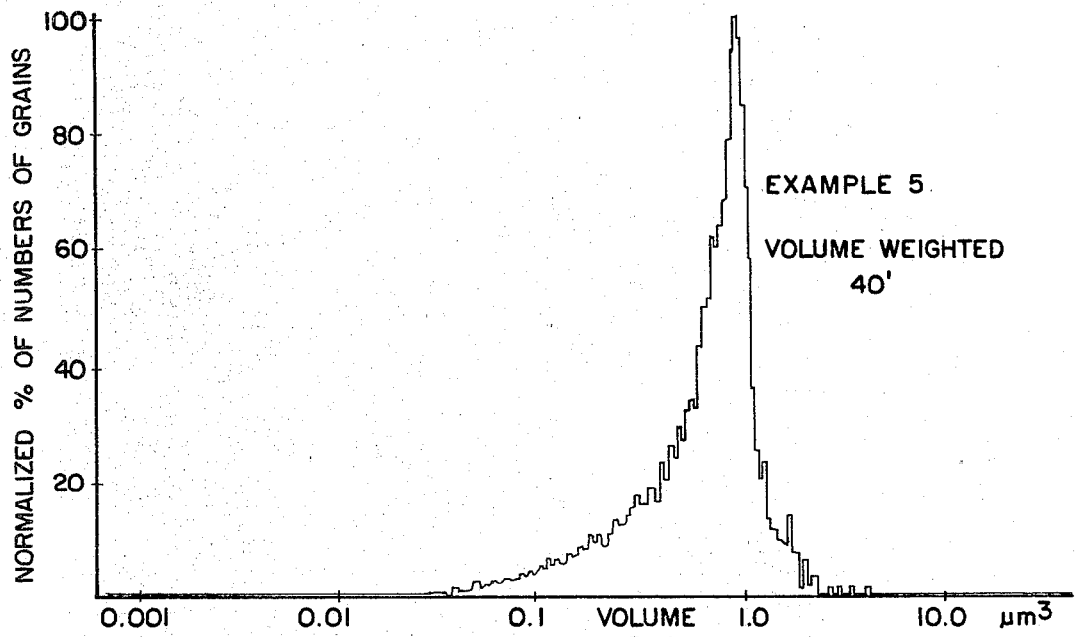
Figure 10D:
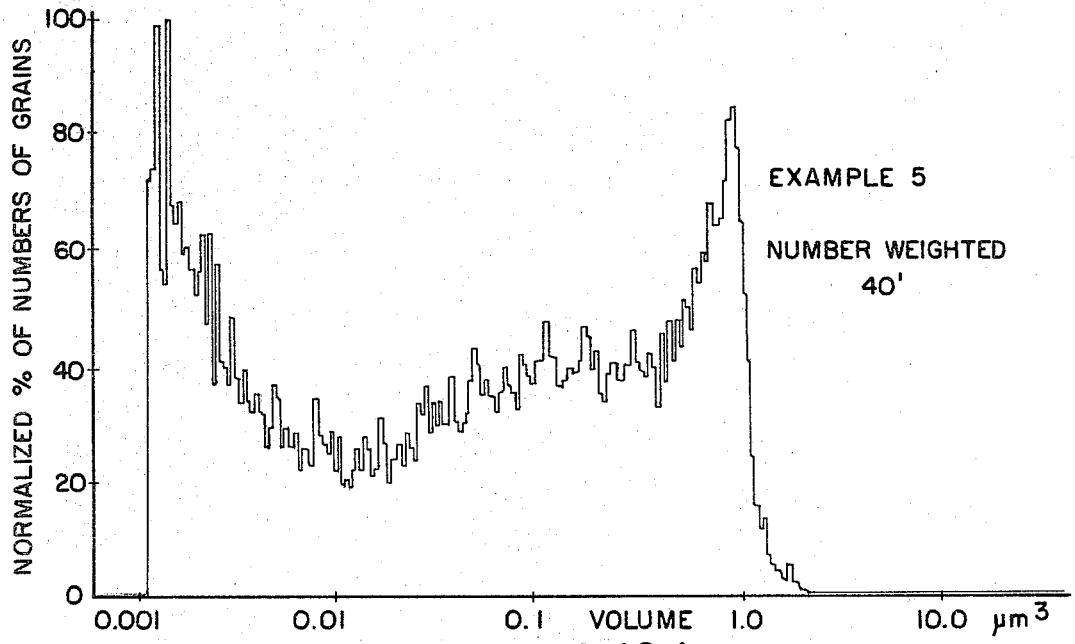
Figure 9E:
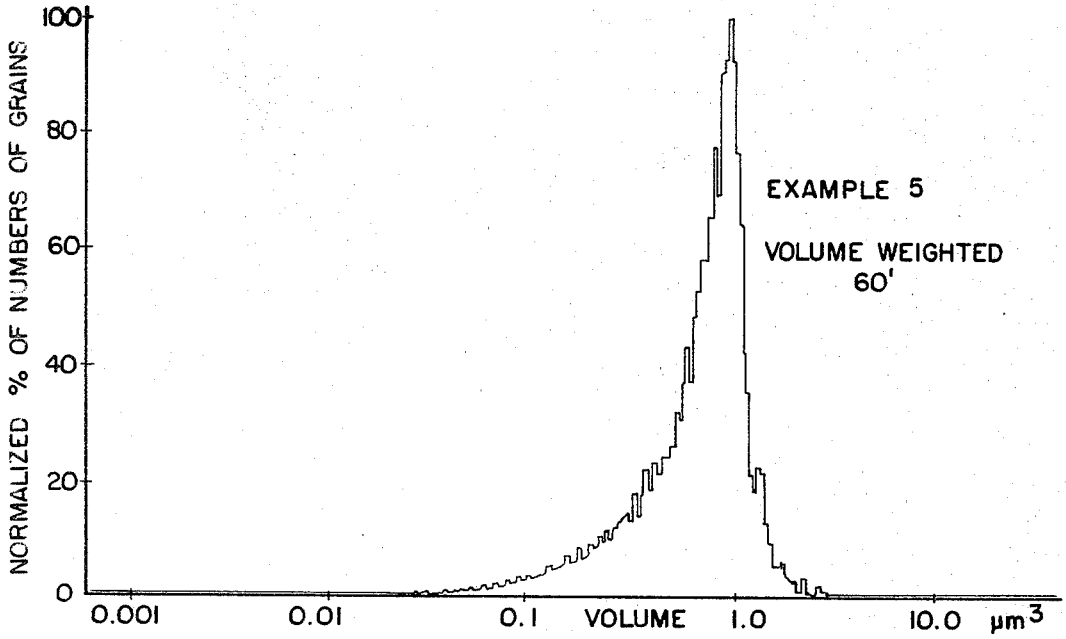
Figure 10E:
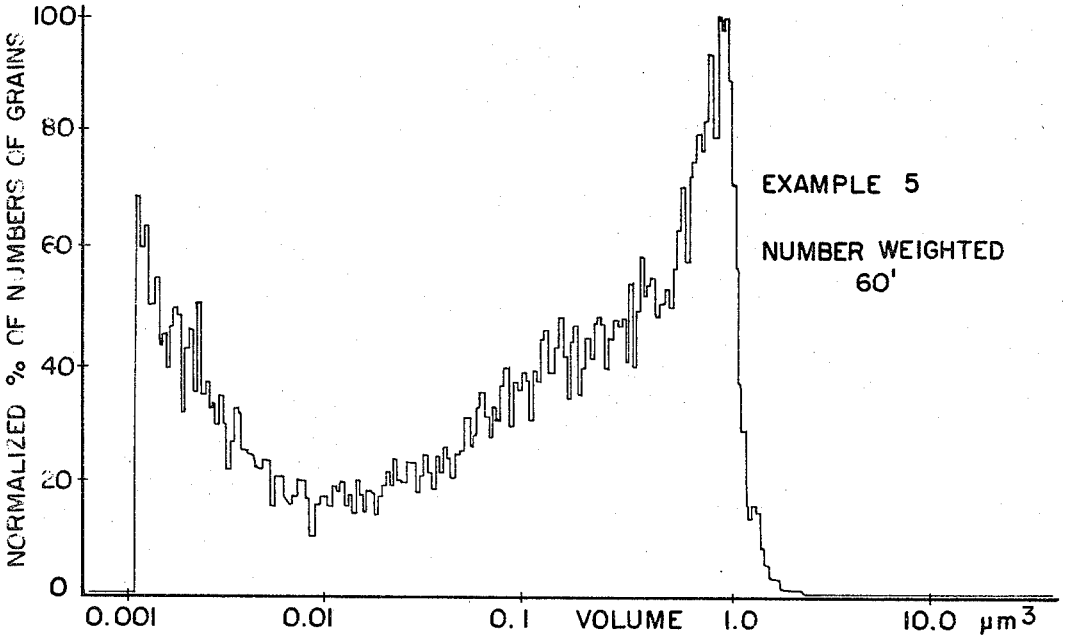
Figure 9F:
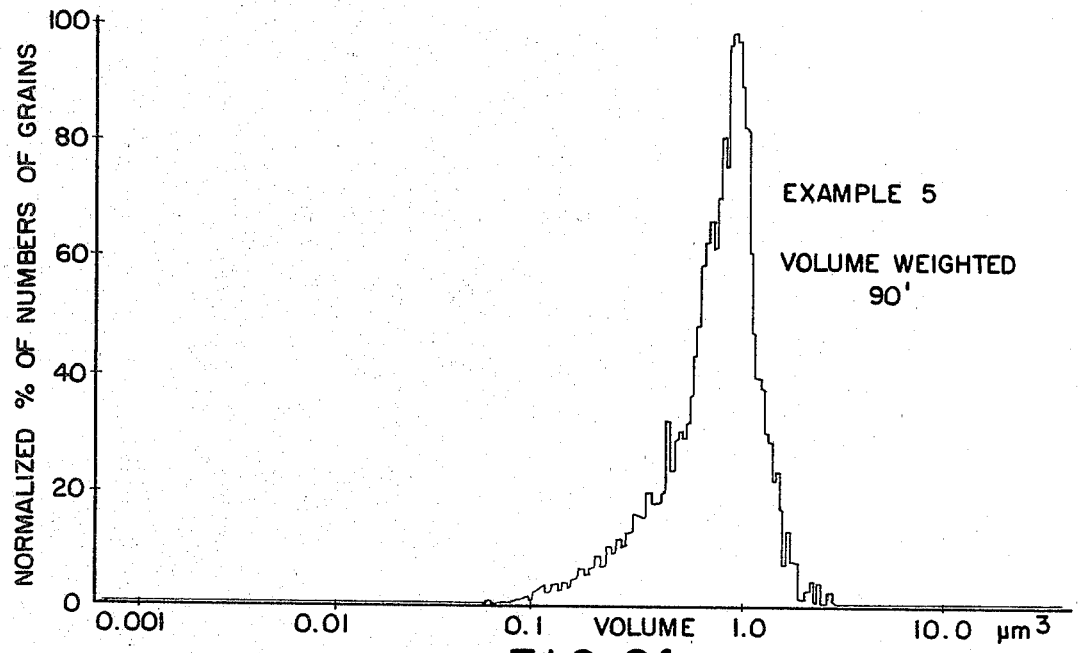
Figure 10F:
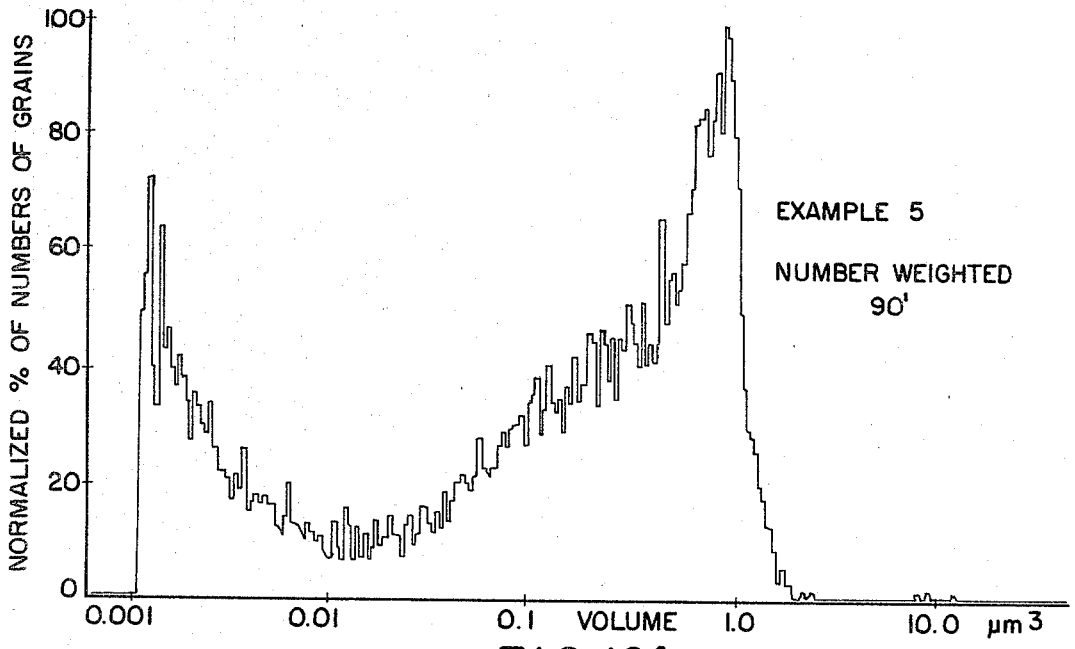
Figure 9G:
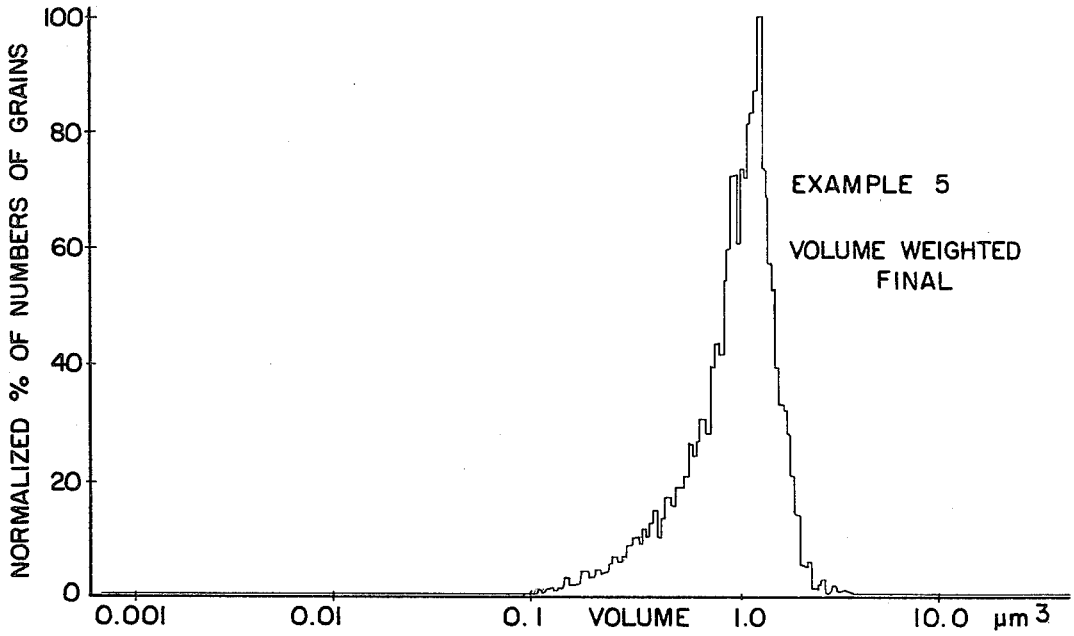
Figure 10G:
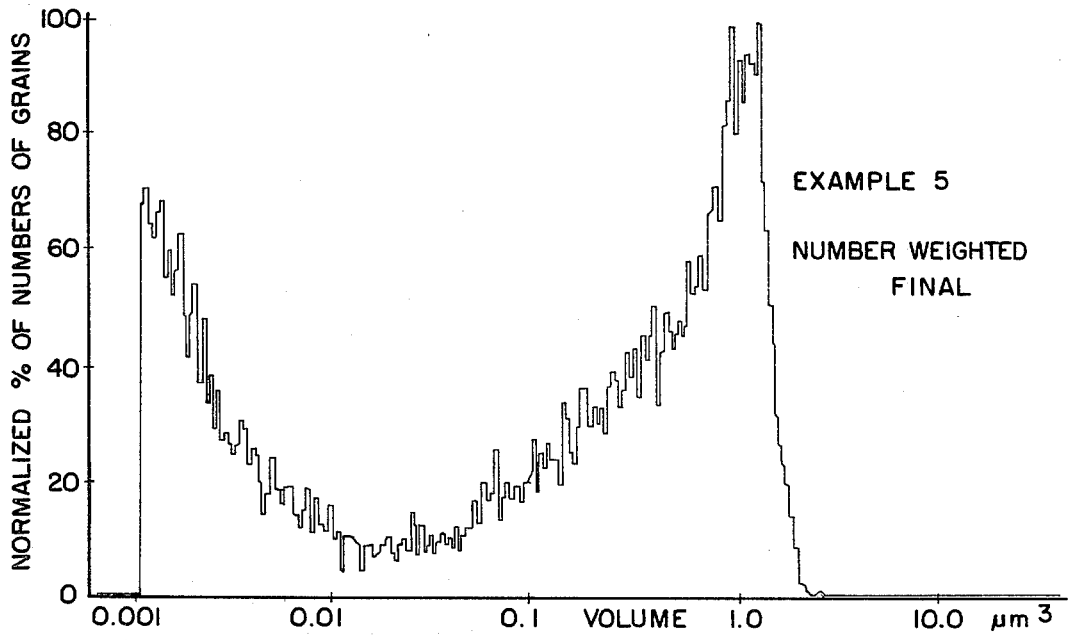

Example 5 is an emulsion prepared within the scope of the present invention and the ripening characteristics are set forth in FIGS. 9–10*g*. The ripening of the emulsion of Example 5 was carried out for ninety minutes. The initial small grain size and a relatively wide grain size distribution is noted at the beginning of the ripening period as well as the rapid growth of the larger grains and the narrowing of the grain size distribution curve occuring as described above. It will be noted that after about 30 minutes, very little change in the mean grain diameter is found and only a slight further narrowing of the mean grain size distribution curve is found. It should be noted, however, that even carrying the ripening period out to ninety minutes, an increase in the larger grains is not observed. This again, is an unexpected phenomenon of the present invention which is not found in the art.

Figure 11:
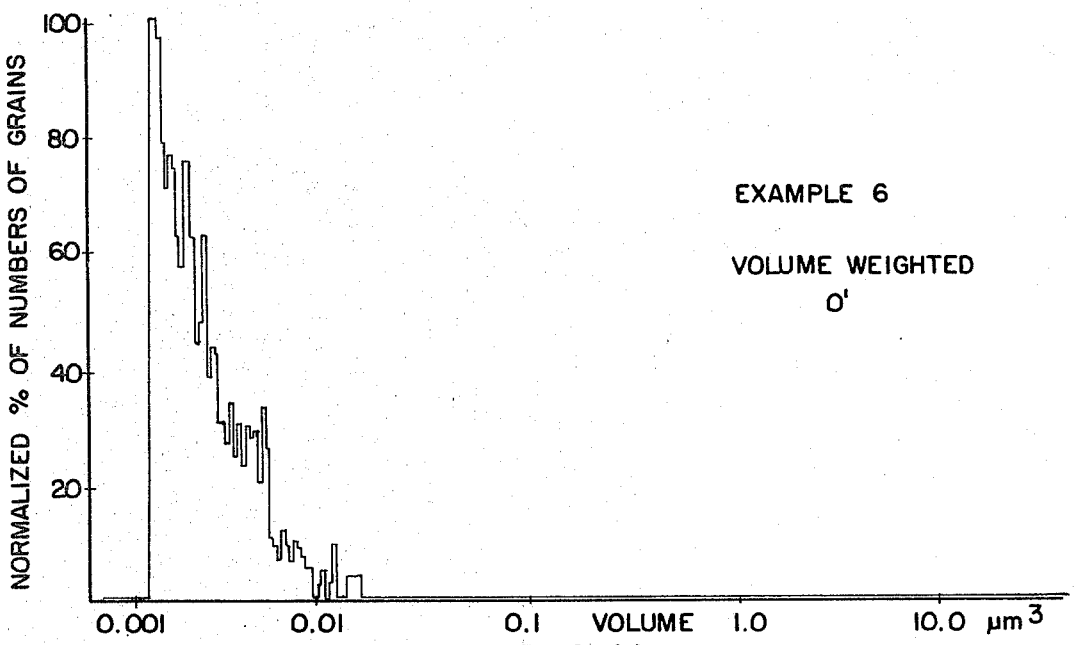
Figure 12:
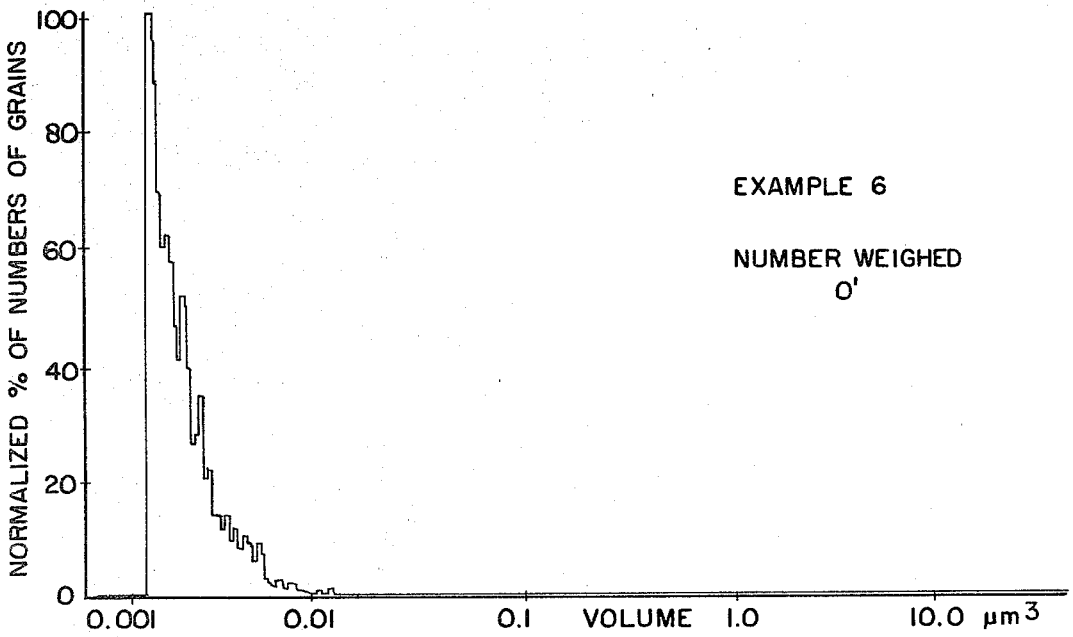
Figure 11A:
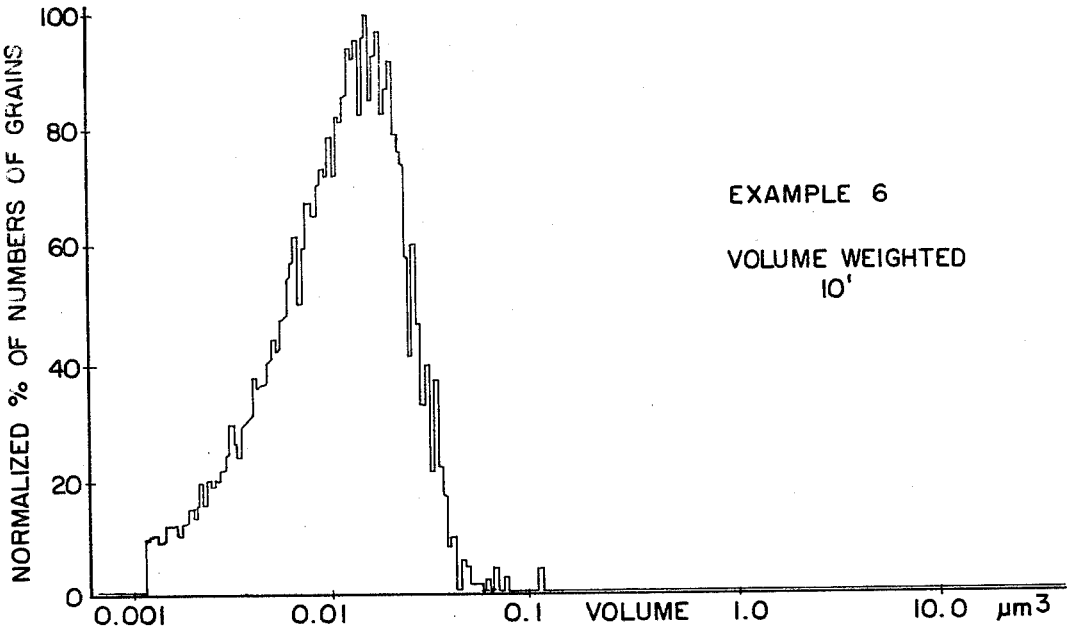
Figure 12A:
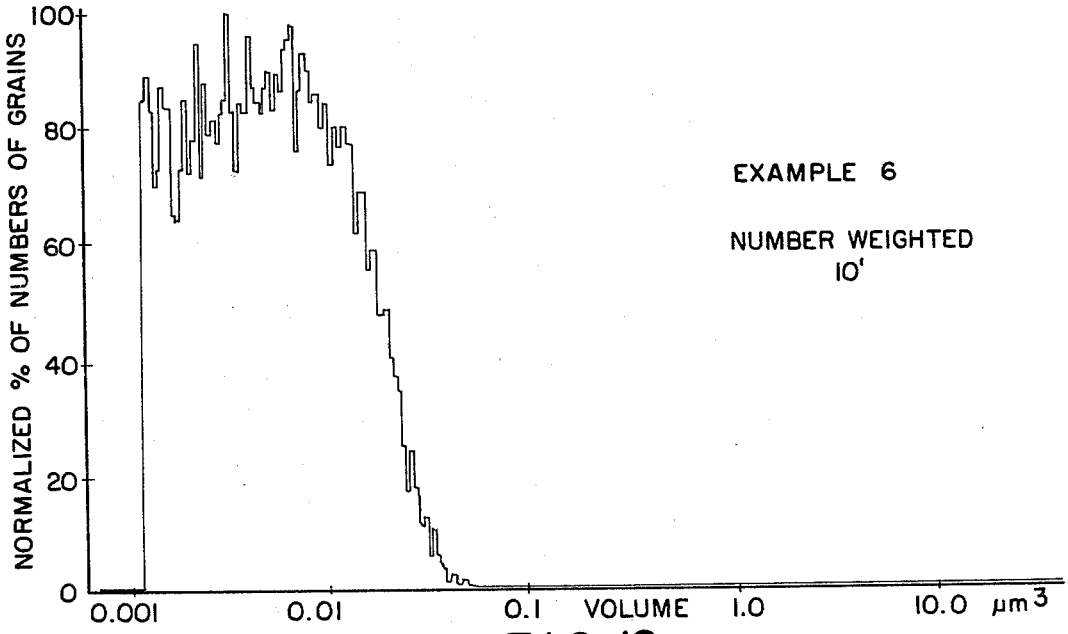
Figure 11B:
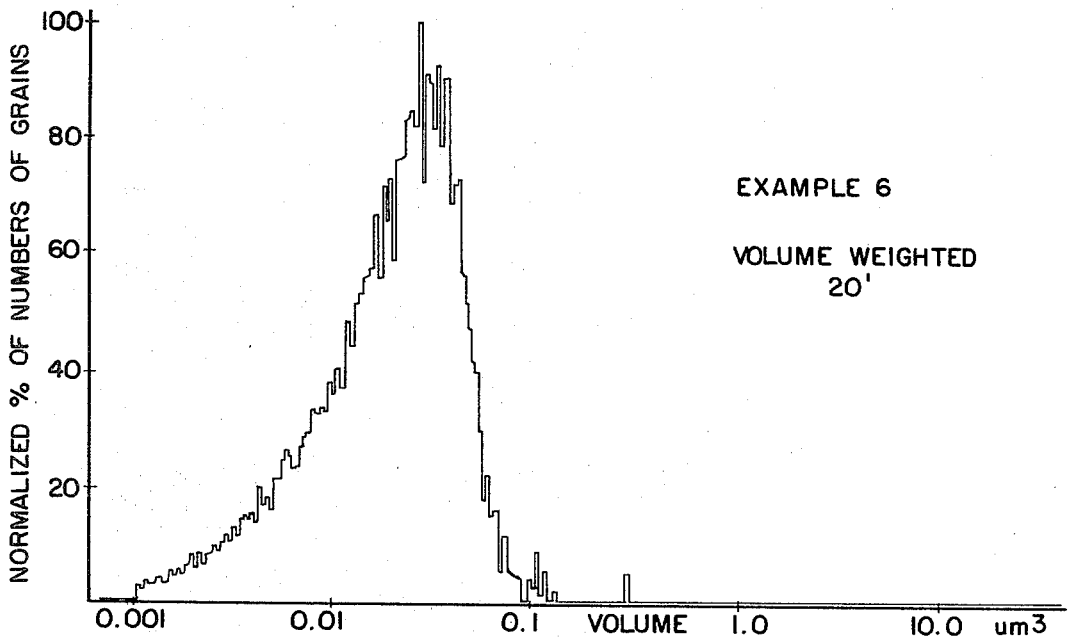
Figure 12B:
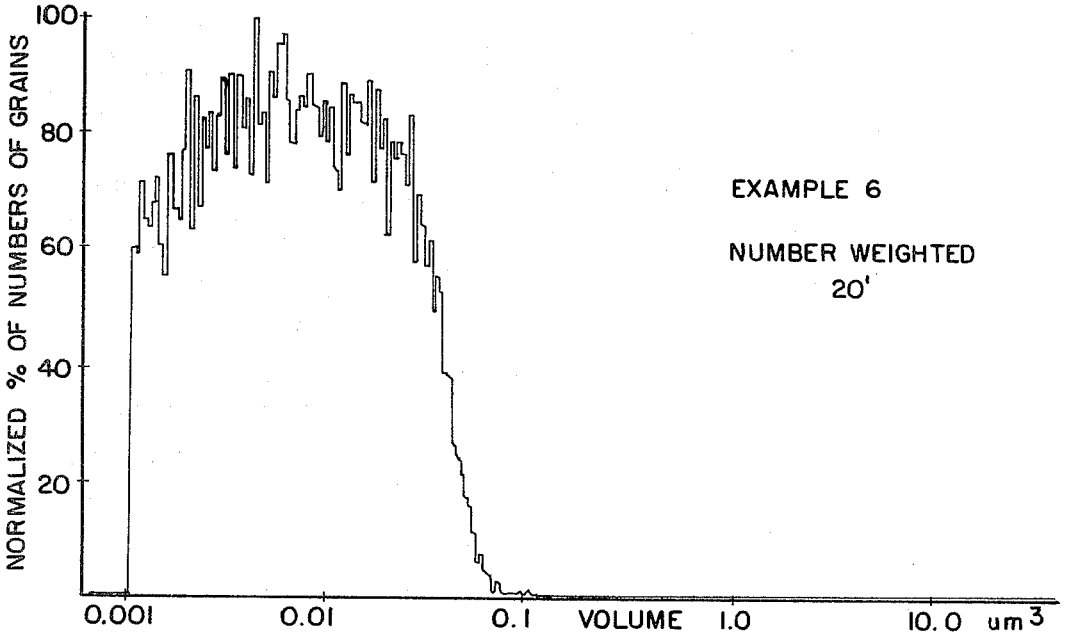
Figure 11C:
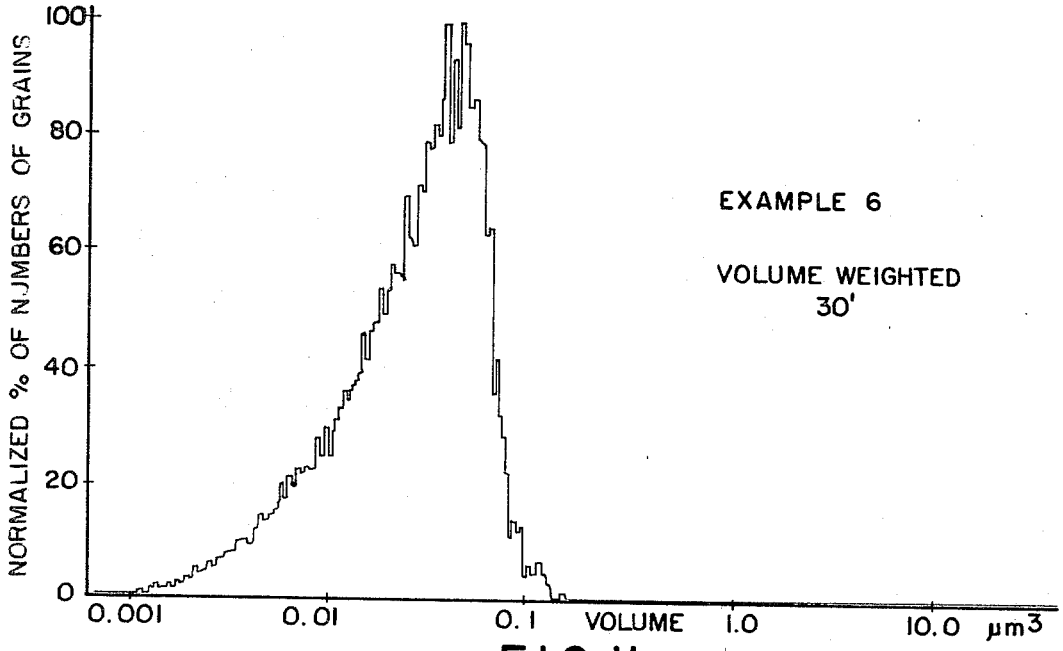
Figure 12C:
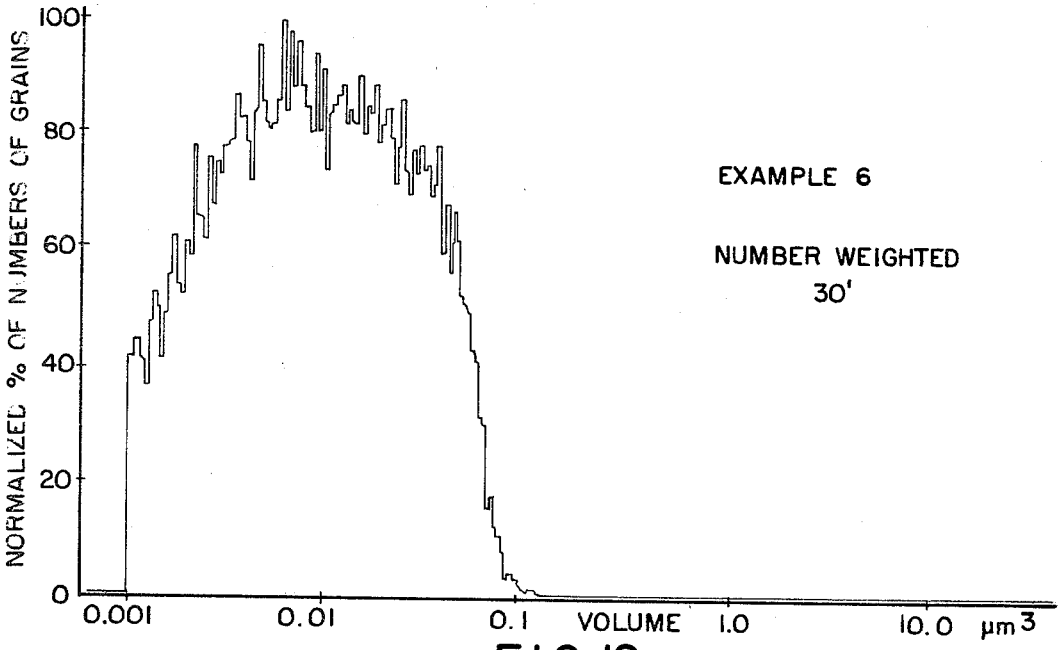
Figure 11D:
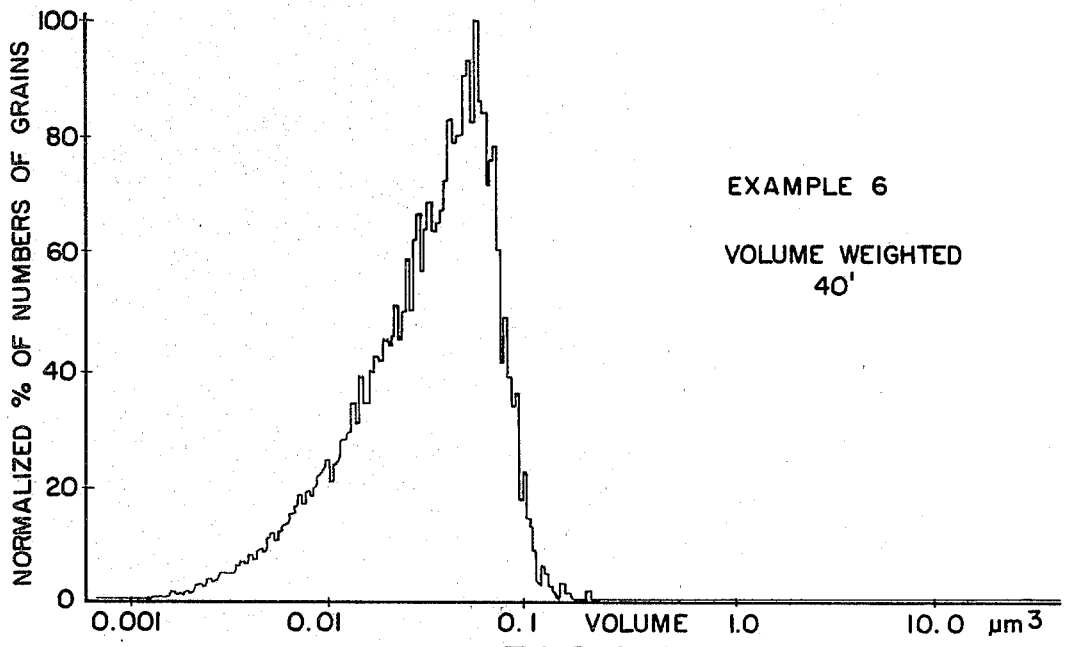
Figure 12D:
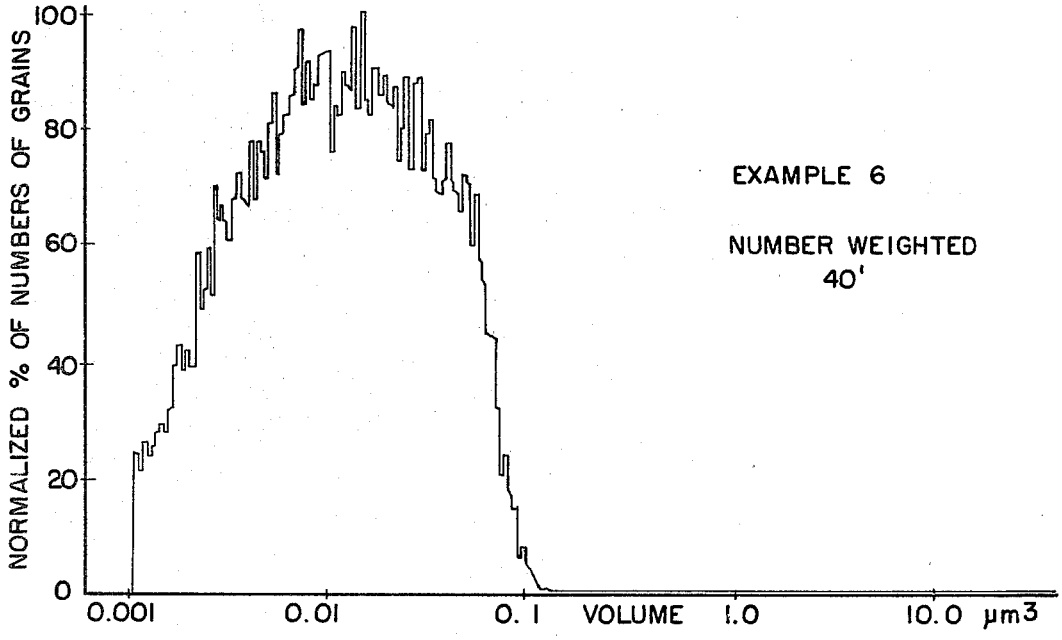
Figure 11E:
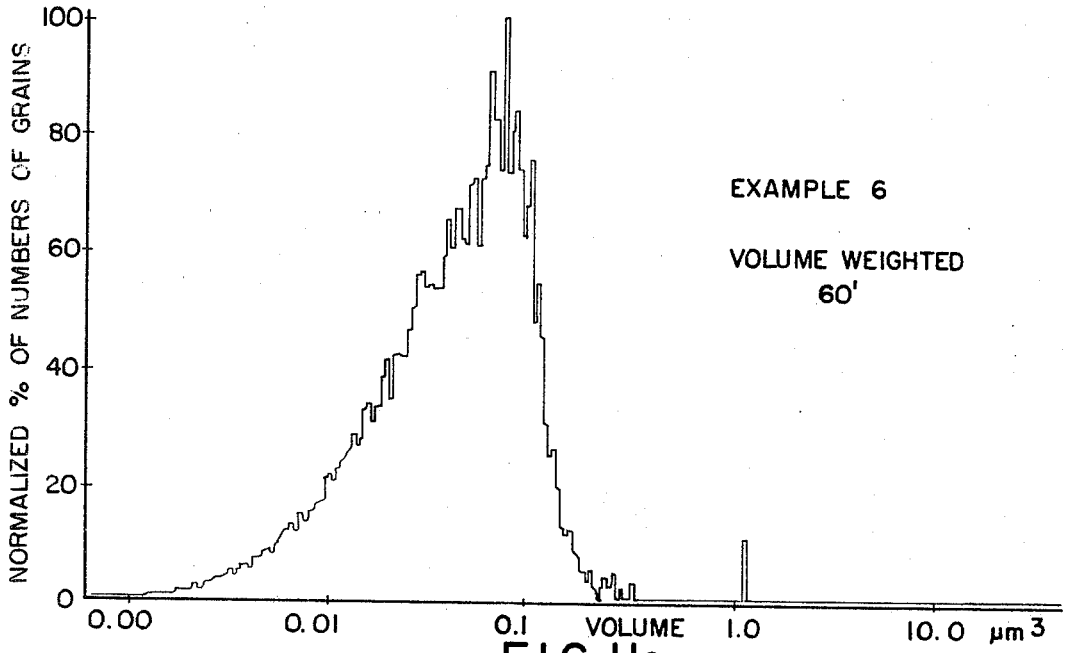
Figure 12E:
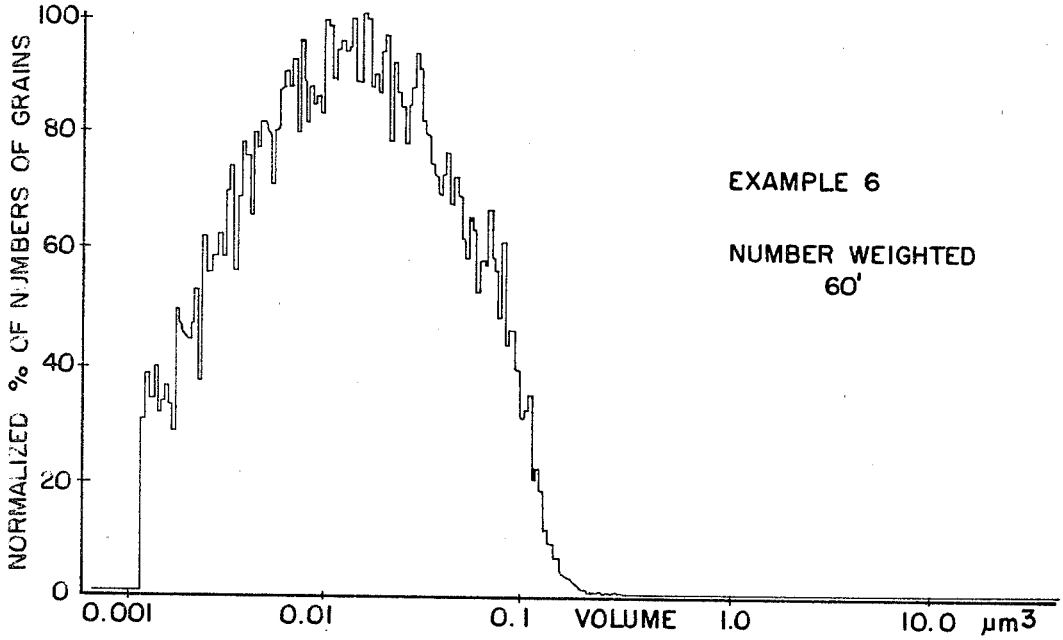
Figure 11F:
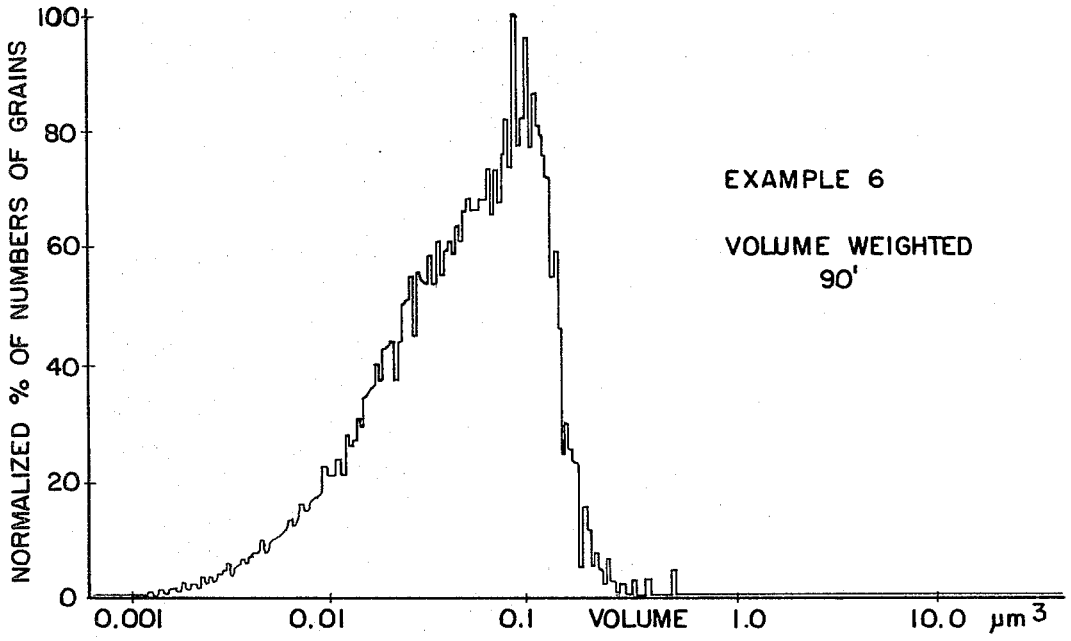
Figure 12F:
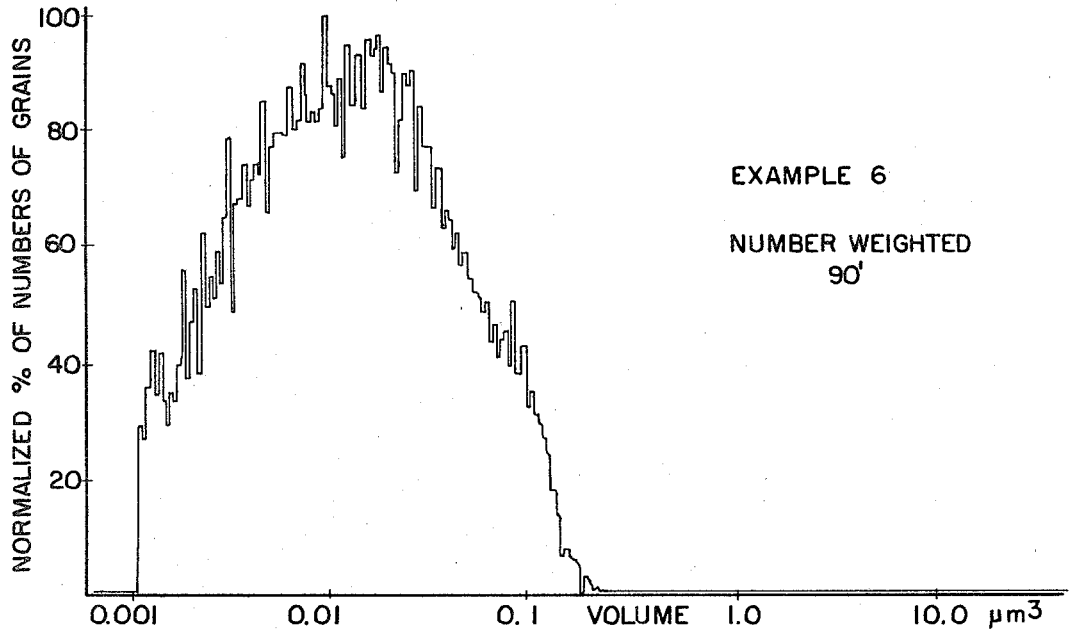
Figure 11G:
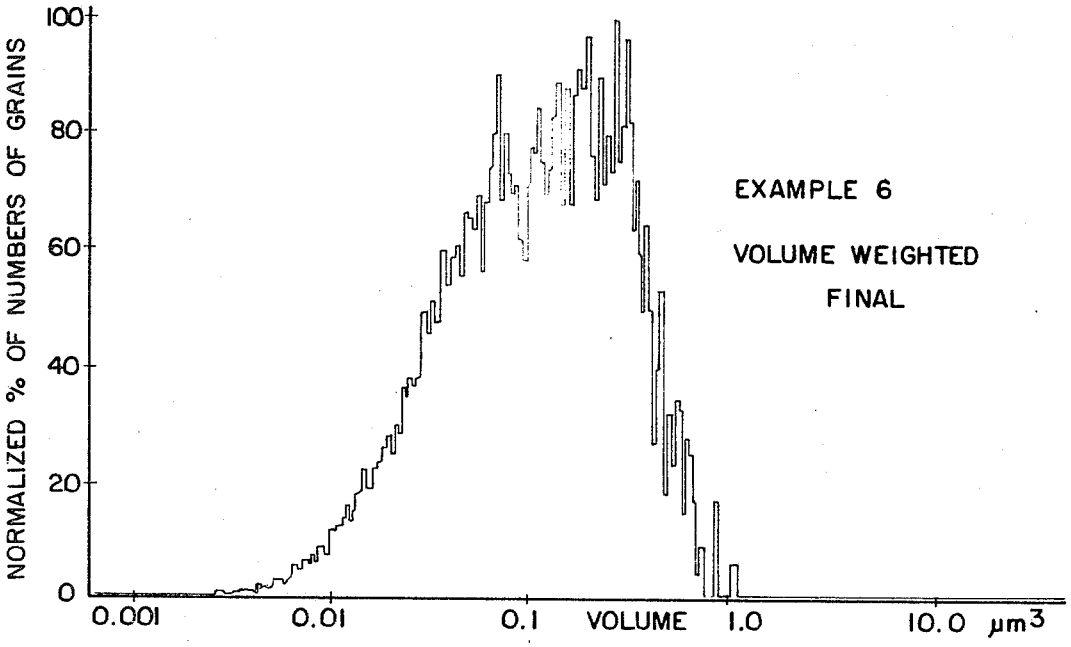
Figure 12G:
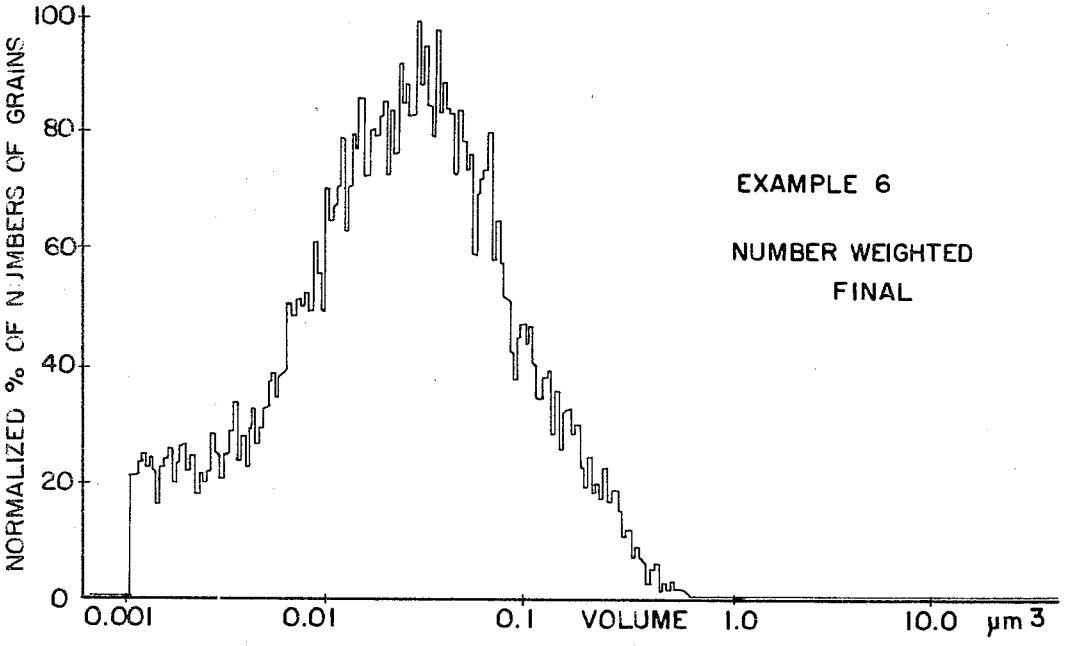

The emulsion of Example 6 is prepared as a control and as a comparison with the emulsion of Example 5. In the emulsion of Example 6, equimolar excess potassium bromide has been substituted for the ammonium thiocyanate ripening agent of the present invention. The growth characteristics of the emulsion are set forth in FIGS. 11–12*g*. It will be noted that as grain growth progresses through ninety minutes, the grain size distribution cure is continually shifted to the right indicating the growth of larger silver halide grains. It should be noticed that the curve becomes wider indicating a significant quantity of various size silver halide grains. The final emulsion shows a mean grain diameter of 0.56 μm and a geometric standard deviation of 3.01.

While grains of a relative wide range of sizes can be prepared by means of the present invention, the method of the present invention is particularly useful in preparing relatively large grains with a relatively narrow grain size distribution. Thus, grains having a mean grain diameter of about 0.6 to 1.5 μm can be prepared having a geometric standard deviation ranging from about 1.4 to 2.0.

With regard to chemical sensitizing agents, suitable for use in the present invention mention may be made of U.S. Pat. Nos. 1,574,944; 1,623,499; 2,410,689; 2,597,856; 2,597,915; 2,487,850, 2,518,698; 2,521,926; and the like, as well as Neblette, C. B., *Photography, Its Materials and Processes,* 6th Ed., 1962.

Reduction sensitization of the crystals prior to the addition of the binder may also be accomplished employing conventional materials known to the art, such as stannous chloride.

Sensitizers of the solid semiconductor type, such as lead oxide, may also be employed.

Spectral sensitization of the silver halide crystals may be accomplished by contact of the crystal composition with an effective concentration of the selected spectral sensitizing dyes dissolved in an appropriate dispersing solvent such as methanol, ethanol, acetone, water and the like; all according to the traditional procedures of the art, as described in Hamer, F. M., *The Cyanine Dyes and Related Compounds.*

Additional optional additives, such as coating aids, hardeners, viscosity-increasing agents, stabilizers, preservatives, and the like, for example, those set forth hereinafter, also may be incorporated in the emulsion formulation, according to the conventional procedures known in the photographic emulsion manufacturing art.

Silver halide emulsions prepared in accordance with this invention may be used, for example, in diffusion transfer processes for forming positive silver transfer images, both reflection prints and transparencies, including additive color transparencies, e.g., as disclosed and claimed in U.S. Pat. No. 3,894,871 issued July 15, 1975, and in subtractive multicolor diffusion transfer processes, particularly multicolor dye developer transfer processes, as disclosed and claimed, for example, in U.S. Pat. Nos. 2,983,606; 3,415,644 and 3,594,165.

What is claimed is:

1. The method for forming a photosensitive silver halide emulsion which comprises the steps of forming photosensitive silver halide grains in the presence of a water-soluble thiocyanate compound with a halide/silver molar ratio ranging from not more than about a 5% molar excess of halide to not more than about a 25% molar excess of silver; ripening said grains subsequent to the forming of said grains in the presence of said water-soluble thiocyanate compound wherein said water-soluble thiocyanate compound is employed at a level of about 0.015 to 1.5 moles per mole of silver, and substantially in the absence of any other ripening agent, for a time sufficient to grow said grains to a predetermined grain size distribution; removing said water-soluble thiocyanate compound subsequent to grain growth and removing any silver thiocyanate formed during precipitation.

2. The method as defined in claim 1 wherein lithium bromide is added to said emulsion at the end of said ripening to dissolve any silver thiocyanate formed during precipitation.

3. The method of claim 1 wherein said precipitation takes place in a molar excess of silver.

4. The method of claim 3 wherein said silver excess is a 1 to 10% molar excess of silver.

5. The method of claim 3 wherein about a 5% molar excess of silver is employed.

6. The method of claim 1 wherein said water soluble thiocyanate compound is employed at a level of about 0.2 mole per mole of silver.

7. A photosensitive silver halide emulsion prepared by the method which comprises the steps of forming photosensitive silver halide grains in the presence of a water-soluble thiocyanate compound with a halide/silver molar ratio ranging from not more than about a 5% molar excess of halide to not more than about a 25% molar excess of silver; ripening said grains subsequent to the forming of said grains in the presence of said water-soluble thiocyanate compound, and substantially in the absence of any other ripening agent, for a time sufficient to grow said grains to a predetermined grain size distribution; removing said water-soluble thiocyanate compound subsequent to grain growth and dissolving any silver thiocyanate formed during precipitation.

8. The emulsion of claim 7 wherein the silver halide grains range from about 0.6 to 1.5 μm with a geometric standard deviation of ranging from about 1.4 to 2.0.

9. The emulsion of claim 8 wherein said grain size is about 1.0 μm and said geometric standard deviation is about 1.7.

* * * * *